US010358312B2

(12) United States Patent
Okawa et al.

(10) Patent No.: US 10,358,312 B2
(45) Date of Patent: Jul. 23, 2019

(54) SHEET PROCESSING APPARATUS AND IMAGE FORMING APPARATUS

(71) Applicant: CANON KABUSHIKI KAISHA, Tokyo (JP)

(72) Inventors: Yuichiro Okawa, Tokyo (JP); Yasuhiro Nakahara, Kawasaki (JP); Masayoshi Fukatsu, Suntou-gun (JP); Naoyuki Maeda, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/784,321

(22) Filed: Oct. 16, 2017

(65) Prior Publication Data

US 2018/0111782 A1 Apr. 26, 2018

(30) Foreign Application Priority Data

Oct. 21, 2016 (JP) ..... 2016-206928
Oct. 24, 2016 (JP) ..... 2016-208156
Jan. 13, 2017 (JP) ..... 2017-004597

(51) Int. Cl.
*B65H 31/02* (2006.01)
*B65H 31/04* (2006.01)
(Continued)

(52) U.S. Cl.
CPC ..... *B65H 31/04* (2013.01); *B65H 31/02* (2013.01); *B65H 31/3018* (2013.01); *B65H 31/34* (2013.01); *B65H 31/38* (2013.01); *G03G 15/6529* (2013.01); *G03G 15/6567* (2013.01); *B65H 37/04* (2013.01);
(Continued)

(58) Field of Classification Search
CPC .... B65H 31/34; B65H 31/02; B65H 31/3018; B65H 31/38; B65H 2405/1111; B65H 2405/11161
See application file for complete search history.

(56) References Cited

U.S. PATENT DOCUMENTS 6,042,106 A * 3/2000 Kelly ..... B65H 29/44 271/188
6,302,606 B1 10/2001 Hayakawa et al.
(Continued)

FOREIGN PATENT DOCUMENTS

JP 64-059363 A 3/1989
JP 2013-082556 A 5/2013
(Continued)

*Primary Examiner* — Howard J Sanders
(74) *Attorney, Agent, or Firm* — Venable LLP

(57) ABSTRACT

A sheet processing apparatus includes a conveyance member configured to convey a sheet, and an alignment portion having a first alignment member and a second alignment member and configured to move relative positions of the first and second alignment members in a width direction orthogonal to a conveyance direction of the sheet by the conveyance member. Each alignment member includes a contact surface coming in contact with one end of the sheet in the width direction, a lower surface facing a lower surface of the sheet that is in contact with the contact surface, a lower portion supporting the lower surface of the sheet that is in contact with the contact surface, and an upper portion facing an upper surface of the sheet that is in contact with the contact surface.

16 Claims, 32 Drawing Sheets

(51) Int. Cl.

| | |
|---|---|
| ***B65H 31/34*** | (2006.01) |
| ***G03G 15/00*** | (2006.01) |
| ***B65H 31/30*** | (2006.01) |
| ***B65H 31/38*** | (2006.01) |
| *B65H 37/04* | (2006.01) |

(52) U.S. Cl.

CPC ..... *B65H 2301/331* (2013.01); *B65H 2301/4212* (2013.01); *B65H 2301/4213* (2013.01); *B65H 2301/4214* (2013.01); *B65H 2405/115* (2013.01); *B65H 2405/1111* (2013.01); *B65H 2405/11161* (2013.01); *B65H 2405/1412* (2013.01); *B65H 2801/06* (2013.01)

(56) References Cited

U.S. PATENT DOCUMENTS

| | | | | |
|---|---|---|---|---|
| 6,561,503 | B1 | 5/2003 | Ogata et al. | |
| 7,874,558 | B2 | 1/2011 | Ogata et al. | |
| 8,038,147 | B2 | 10/2011 | Ogata et al. | |
| 8,235,383 | B2 * | 8/2012 | Masaki ..... | G03G 15/6552 271/188 |
| 8,540,229 | B2 | 9/2013 | Tsuji | |

FOREIGN PATENT DOCUMENTS

| | | | |
|---|---|---|---|
| JP | 2013-205589 | A | 10/2013 |
| JP | 2014-019569 | A | 2/2014 |

* cited by examiner

SHEET PROCESSING APPARATUS AND IMAGE FORMING APPARATUS

BACKGROUND OF THE INVENTION

Field of the Invention

The present invention relates to a sheet processing apparatus that performs a process such as aligning sheets, and an image forming apparatus equipped with the sheet processing apparatus.

Description of the Related Art

Sheet processing apparatuses, which perform processes such as an aligning process and a stapling process to sheets on which images are formed by image forming apparatuses, are generally equipped with sheet alignment devices to align sheets serving as processing targets to a processing position. Some sheet alignment devices are equipped with a pair of alignment members respectively equipped with contact surfaces that come in contact with edges of the sheets in the width direction, and that can move relatively in the width direction to align the positions of the sheets.

Japanese Unexamined Patent Application Publication No. 2013-082556 discloses a sheet processing apparatus equipped with a pair of alignment portions capable of moving relatively in a width direction, and a sheet discharge tray arranged below the pair of alignment portions. Each alignment portion includes a supporting portion configured to support a lower surface of a sheet, and perpendicular portions standing upright from the supporting portion. Projected portions provided on each of the two perpendicular portions abut with side edges of the sheet to align the sheet with respect to the width direction. A sheet bundle subjected to aligning and stapling processes is stacked on the sheet discharge tray with the pair of alignment portions retracted outside of the sheet in the width direction.

In the sheet processing apparatuses, however, there are cases where the process target sheets were curved when viewed from the conveyance direction. According to the configuration disclosed in the above-described document, the sheets held by the pair of alignment portions were sagged downward between the two supporting portions by the own weight of the sheets. The sheets are not only curved by gravity, but they are also sometimes curved by curling of the sheets. If such curve occurs, even if the pair of alignment members is moved to the alignment target position, the curvature of the sheet prevents one end or both ends of the sheet from being in contact with the contact surfaces of the alignment members, and the sheet may be misaligned with respect to the alignment target position.

SUMMARY OF THE INVENTION

The present invention provides a sheet processing apparatus configured to align sheets with high accuracy, and an image forming apparatus equipped with the sheet processing apparatus.

According to one aspect of the present invention, a sheet processing apparatus includes: a conveyance member configured to convey a sheet; and an alignment portion including a first alignment member and a second alignment member and configured to move relative positions of the first and second alignment members in a width direction orthogonal to a conveyance direction of the sheet by the conveyance member, so as to align a position of the sheet in the width direction. The first alignment member includes: a first contact surface configured to come in contact with one end of the sheet in the width direction; a first lower portion configured to support a lower surface of the sheet that is in contact with the first contact surface; and a first upper portion facing an upper surface of the sheet that is in contact with the first contact surface, wherein the first lower portion is more distant from the first contact surface than the first upper portion in the width direction in a plane vertical to the conveyance direction, the first lower portion is positioned above a lower end of the first contact surface in a gravity direction, and a distance between the first upper portion and the first lower portion in the gravity direction is smaller than a length of the first contact surface in the gravity direction. The second alignment member includes: a second contact surface configured to come in contact with the other end of the sheet in the width direction; a second lower portion configured to support a lower surface of the sheet that is in contact with the second contact surface; and a second upper portion facing an upper surface of the sheet that is in contact with the second contact surface, wherein the second lower portion is more distant from the second contact surface than the second upper portion in the width direction in the plane vertical to the conveyance direction, the second lower portion is positioned above a lower end of the second contact surface in the gravity direction, and a distance between the second upper portion and the second lower portion in the gravity direction is smaller than a length of the second contact surface in the gravity direction.

According to another aspect of the present invention, a sheet processing apparatus includes: a conveyance member configured to convey a sheet; a pair of alignment members configured to move relatively in a width direction orthogonal to a conveyance direction of the sheet by the conveyance member, so as to align a position of the sheet in the width direction; a lower portion configured to support a lower surface of the sheet between the pair of alignment members in the width direction; and a pair of upper portions arranged on one side and the other side of the lower portion in the width direction and each configured to hold an upper surface of the sheet, wherein the pair of upper portions is positioned lower than the lower portion in a plane vertical to the conveyance direction.

According to still another aspect of the present invention, a sheet processing apparatus includes: a conveyance member configured to convey a sheet; and a pair of alignment members configured to move relatively in a width direction orthogonal to a conveyance direction of the sheet by the conveyance member, so as to align a position of the sheet in the width direction, the pair of alignment members each including a contact surface configured to come in contact with an end portion of the sheet in the width direction. At least one of the pair of alignment members includes a lower portion configured to support a lower surface of the sheet that is in contact with the contact surface, and an upper portion positioned between the lower portion and the contact surface in the width direction and configured to hold an upper surface of the sheet that is in contact with the contact surface, wherein in a plane orthogonal to the conveyance direction, the lower portion is positioned above a lower end of the contact surface in a gravity direction, and a distance between the upper portion and the lower portion in the gravity direction is smaller than a length of the contact surface in the gravity direction.

Further features of the present invention will become apparent from the following description of exemplary embodiments with reference to the attached drawings.

DESCRIPTION OF THE EMBODIMENTS

Now, an image forming apparatus according to the present disclosure will be described with reference to the drawings. The term "image forming apparatus" includes printers, copying machines, facsimiles, and multifunction printers equipped with these functions.

First Embodiment

Figure 1:
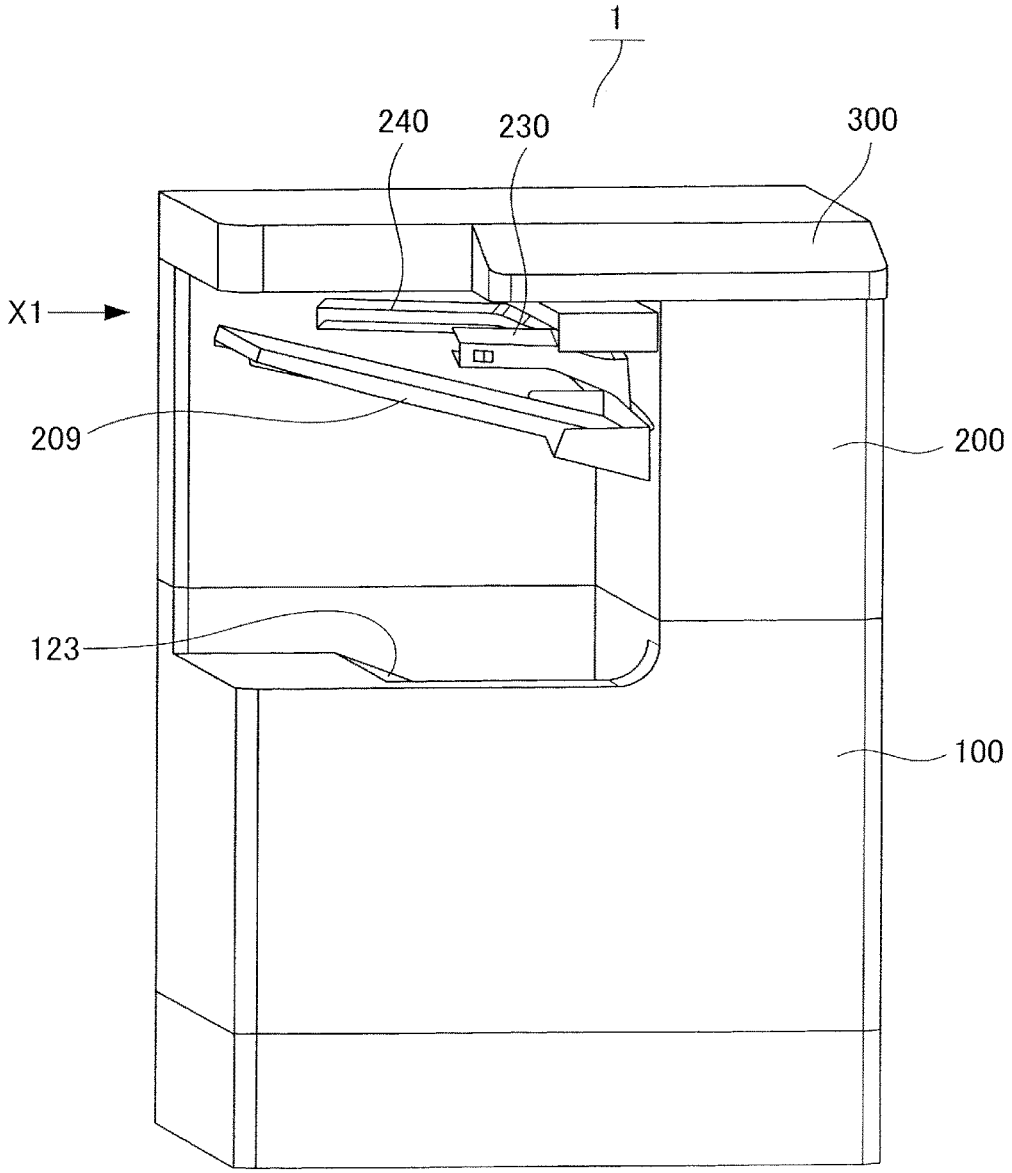
FIG. 1 is a perspective view of an image forming apparatus according to the present disclosure.
Figure 2:
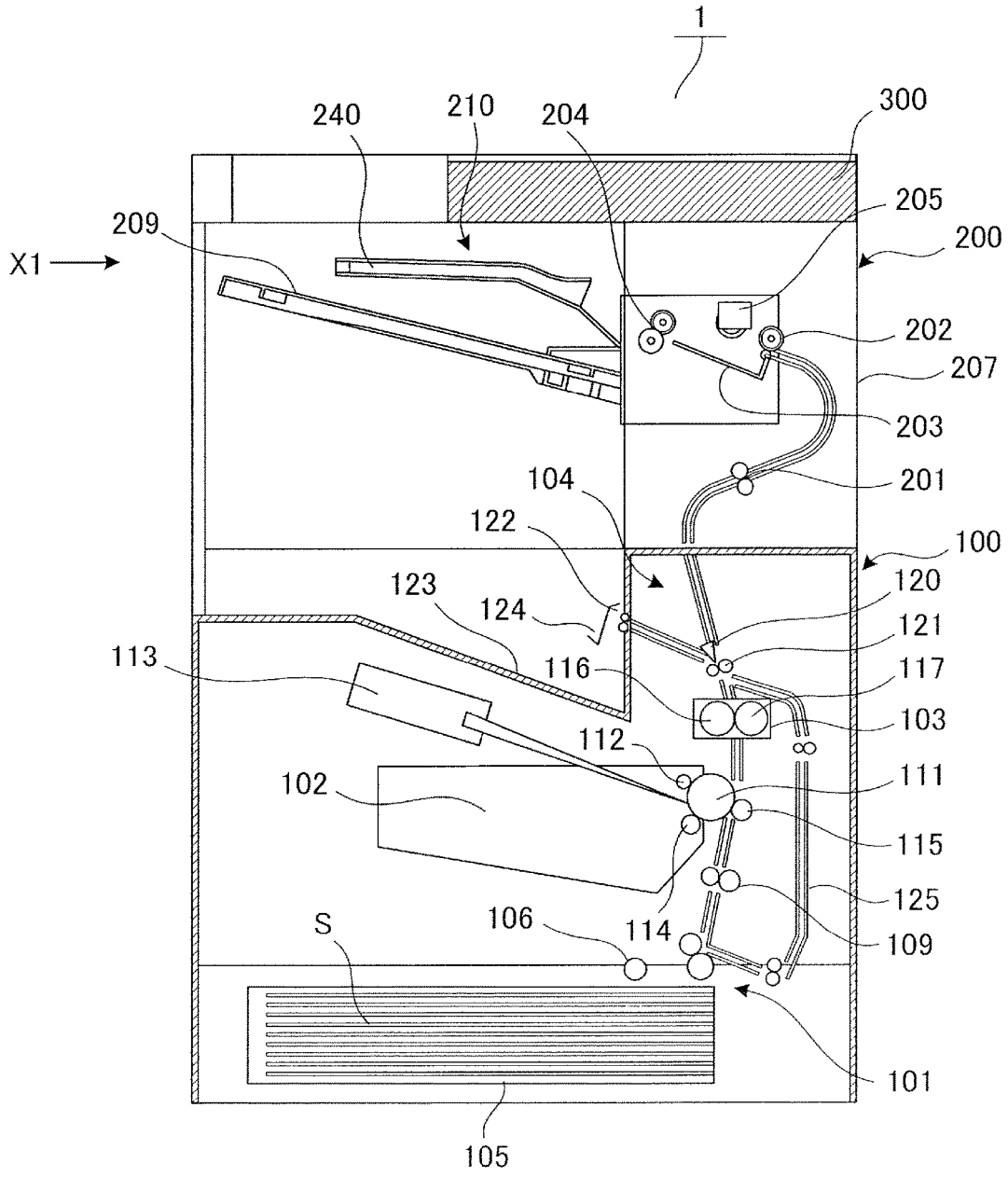
FIG. 2 is a schematic view illustrating a configuration of the image forming apparatus according to the present disclosure.

An image forming apparatus 1 according to the first embodiment is a multifunction printer equipped with an image forming apparatus body 100 having an image forming portion 102 that adopts an electro-photographic system, and a sheet processing apparatus 200 providing stapling and other processes to sheets S onto which image has been formed, as illustrated in FIGS. 1 and 2. FIG. 1 is a perspective view of the image forming apparatus 1, and FIG. 2 is a schematic view illustrating a configuration of the image forming apparatus 1.

As illustrated in FIG. 1, the sheet processing apparatus 200 is attached detachably to an upper portion of the image forming apparatus body 100, and on an upper portion of the sheet processing apparatus 200 is arranged an image reading apparatus 300 configured to read image data from a document. In the following description, "front side" and "back side" refer to a front side and a back side from the viewpoint of FIG. 1.

As illustrated in FIG. 2, the image forming apparatus body 100 is equipped with a direct-transfer type image forming portion 102 in which a toner image formed on a photosensitive drum 111 serving as a photoconductor is directly transferred onto a sheet S. Sheet S refers to, in addition to plain paper, special paper such as coated paper, recording material having a particular shape such as an envelope or an index sheet, and recording media including plastic film for overhead projector, and cloth.

If start of an image forming operation is requested to the image forming portion 102, the photosensitive drum 111 of the image forming portion 102 is driven to rotate. The surface of the photosensitive drum 111 is charged uniformly by a charging apparatus 112, and exposed by an exposing unit 113. The exposing unit 113 modulates and outputs laser beams based on image data read by the image reading apparatus 300 or image data entered from a host computer connected via a network, and forms an electrostatic latent image on a surface of the photosensitive drum 111. Then, the electrostatic latent image is visualized, i.e., developed, by toner supplied from a developing apparatus 114, thus a toner image being formed.

Simultaneously as the image forming operation, a sheet feeding unit 101 executes a feeding operation in which a sheet S is fed to the image forming portion 102. The sheet feeding unit 101 includes a sheet supporting device 105 such as a cassette configured to supports sheets S, and a feed roller 106 serving as a feeding means for feeding the sheets S supported on the sheet supporting device 105. The sheets S fed from the sheet supporting device 105 by the feed roller 106 is conveyed to a registration unit 109 in a state being separated one sheet at a time by a separating mechanism that adopts a retard separation system or a separation pad system.

The registration unit 109 performs skew feed correction of the sheet S, and conveys the sheet S toward a transfer device 115 at a matched timing with the advancement of the image forming operation in the image forming portion 102. The transfer device 115 composed of a transfer roller transfers the toner image borne on the photosensitive drum 111 to the sheet S by electrostatic bias at a transfer nip portion formed between the transfer roller and the photosensitive drum 111. The sheet S to which an unfixed toner image has been transferred is conveyed to a fixing unit 103, where the sheet S is heated and pressed while being nipped by a fixing roller 116 and a pressing roller 117. The sheet S to which a fixed image has been formed by the toner being melted and fixed is transferred to a sheet discharge unit 104.

The sheet discharge unit 104 is equipped with a conveyance roller pair 121 that can be rotated in normal and reverse directions, and a flap-like switching member 120 capable of switching the conveyance direction of the sheet S between a route that leads to a main-body sheet discharge portion 123 and a route that leads to the sheet processing apparatus 200. If processing by the sheet processing apparatus 200 is not necessary, the sheet S is guided by the switching member 120 toward a sheet discharge roller pair 122. The sheet discharge roller pair 122 discharges the sheet S in a face-down state, that is, in a state where a surface on which the toner image has been formed is faced downward, to the main-body sheet discharge portion 123 provided on an upper portion of the image forming apparatus body 100. A sheet amount sensor 124 serving as a full-load detection unit that can detect the quantity of the sheets S supported on the main-body sheet discharge portion 123 is arranged above the main-body sheet discharge portion 123. The image forming apparatus body 100 is designed to discontinue the image forming operation if the amount of supported sheets exceeds a fixed value based on a detection signal from the sheet amount sensor 124.

In contrast, if processes such as stapling is set to be performed to the sheets S to which image has been formed, the sheets S are guided toward the sheet processing apparatus 200 described later by the switching member 120. The switching member 120 also guides the sheet S toward the sheet processing apparatus 200 if the setting does not require processes to be performed to the sheet S but requires the sheet S to be discharged to a sheet discharge tray 209 of the sheet processing apparatus 200.

Further, if duplex printing of forming images on both sides of the sheet S is to be performed, the reverse rotation of the conveyance roller pair 121 causes the sheet S to be switched back, and the sheet S is conveyed to the registration unit 109 through a reverse conveyance portion 125. Then, the sheet S to which an image has been formed on a rear surface by the image forming portion 102 is conveyed through a path arbitrarily selected by the switching member 120 to the main-body sheet discharge portion 123 or the sheet processing apparatus 200.

The above-described image forming portion 102 is one example of an image forming portion in which an image is formed to a sheet S. The image forming portion can also adopt other configurations such as a color image forming portion of a tandem-type intermediate transfer system, or an image forming engine, such as an ink-jet system, other than the electro-photographic system.

Sheet Processing Apparatus

Next, we will describe the sheet processing apparatus 200. The processing of sheets according to the present disclosure includes binding processes such as stapling, aligning processes of each sheet or of a predetermined number of sheets, punching processes, and folding processes.

Figure 3:
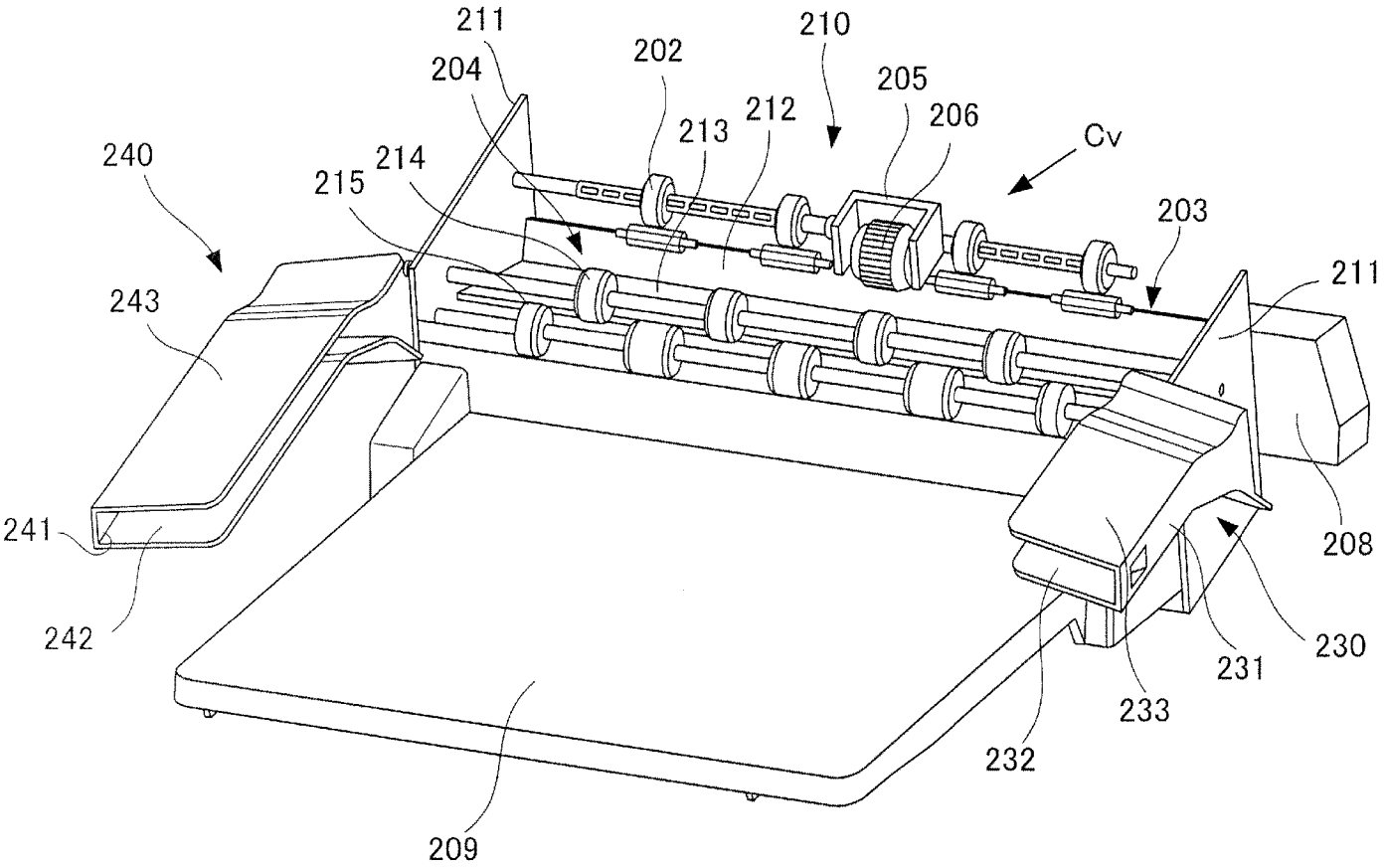
FIG. 3 is a perspective view of a sheet alignment device according to a first embodiment.

As illustrated in FIG. 2, the sheet processing apparatus 200 is equipped with a first conveyance roller pair 201, a second the conveyance roller pair 202, an intermediate tray 203, a conveyance direction alignment portion 205, a widthwise alignment member 240, a sheet discharge roller pair 204, and a sheet discharge tray 209. Further, as illustrated in FIG. 3, the sheet processing apparatus 200 is equipped with a stapler 208 that can perform stapling, serving as an example of a processing mechanism configured to process sheets supported on the intermediate tray 203. The intermediate tray 203, the conveyance direction alignment portion 205 and widthwise alignment members 230 and 240 constitute a sheet alignment device 210, i.e., a sheet alignment apparatus configured to align sheets S.

The first conveyance roller pair 201 receives the sheet S discharged toward the upward direction from the image forming apparatus body 100 and transfers the same to the second conveyance roller pair 202. The second the conveyance roller pair 202 serving as an example of the conveyance member transfers the sheet S further to the sheet alignment device 210. The sheet alignment device 210 holds the sheet S by the intermediate tray 203 and the widthwise alignment members 230 and 240, and aligns the sheet S at an alignment target position by the conveyance direction alignment portion 205 and the widthwise alignment members 230 and 240. Incidentally, alignment target position refers to a sheet position set according to the processing content, and if stapling is performed, for example, a position corresponding to a binding position of the stapler 208 is set as the alignment target position.

As illustrated in FIG. 3, the conveyance direction alignment portion 205 is arranged above the intermediate tray 203, and is equipped with a friction roller 206 rotatable around an axis of a direction orthogonal to the conveyance direction shown by arrow Cv, that is, around an axis extending in a width direction of the sheet S. The conveyance direction alignment portion 205 is capable of moving between a contact position in which the friction roller 206 contacts an upper surface of the sheet S supported on the intermediate tray 203 and a separated position in which the friction roller 206 is separated upward from the sheet S.

The intermediate tray 203 serving as a supporting portion temporarily supporting the sheet S serving as a processing target of the sheet processing apparatus 200 includes a support surface 213 supporting an upstream portion of the sheet S in the conveyance direction, and a first reference wall 212 standing upward from an upstream end of the support surface 213. Support plates 211 and 211 supporting the roller shaft of the second the conveyance roller pair 202 and the sheet discharge roller pair 204 rotatably are arranged to stand on both sides of the intermediate tray 203 in the width direction. A projected portion having a second reference wall 221 is arranged on a front side of the intermediate tray 203 (refer to FIG. 4).

The widthwise alignment members 230 and 240 are a pair of alignment members of a first alignment member 230 arranged on a front side, that is, one side in the width direction, of the sheet processing apparatus 200, and a second alignment member 240 arranged on a back side, that is, the other side in the width direction, of the apparatus. Each alignment member 230 and 240 has a C-shaped cross-sectional shape that is opened toward a middle part in the width direction viewed from the conveyance direction. In other words, the alignment members 230 and 240 are each equipped with a side wall 231 or 241 opposed to a side edge of the sheet S, that is, end portion of the sheet S in the width direction. Lower support surfaces 232 and 242 and upper support surfaces 233 and 243 extend from upper and lower ends of the side walls 231 and 241 toward a middle part in the width direction. Further, a third reference wall 234 protruding toward a back side from a wall surface is arranged on the side wall 231 of the first alignment member 230 (refer to FIG. 4).

The first alignment member 230 contacts one side edge of the sheet S by the third reference wall 234, and the second alignment member 240 contacts the other side edge of the sheet S by the side wall 241. In other words, the third reference wall 234 and the side wall 241 respectively correspond to the first and second contact surfaces that come in contact with the sheet S. It is also possible to adopt a configuration where the side wall 231 of the first alignment member 230 contacts a side edge of the sheet S, and to provide a projecting portion that serves as a contact surface to the side wall 241 of the second alignment member 240. Further, the lower support surfaces 232 and 242 respectively correspond to first and second lower surfaces, i.e., lower side opposing surfaces, that oppose to the lower surface of the sheet S in contact with the first and second contact surfaces, and the upper support surfaces 233 and 243 respectively correspond to first and second upper surfaces, i.e., upper side opposing surfaces, that oppose to the upper surface of the sheet S in contact with the first and second contact surfaces.

The widthwise alignment members 230 and 240 are relatively movable with respect to the width direction by an actuator composed of a motor, a drive transfer belt and the like not shown. Specifically, the respective alignment members 230 and 240 are movable with respect to the width direction between a retracting position retracting to an outer side of the sheet discharge tray 209 (position of FIG. 3) and an alignment position corresponding to the alignment position of the sheet S. Here, the alignment position refers to a position set so that the contact surfaces 234 and 241 of the respective alignment members 230 and 240 contact the side edges of the sheet S in correspondence with the sheet width of the sheet S in a state where the sheet S is positioned at the alignment target position.

The sheet discharge roller pair 204 is one example of a sheet discharge member configured to discharge sheets aligned by the sheet alignment device 210, and the roller pair is arranged between the intermediate tray 203 and the widthwise alignment members 230 and 240 with respect to the conveyance direction. The sheet discharge tray 209 serving as an example of the sheet discharge portion on which the sheet discharged from the sheet discharge member is supported is arranged below the widthwise alignment members 230 and 240. The sheet discharge roller pair 204 is a so-called comb-toothed roller pair in which a plurality of upper rollers 214 and a plurality of lower rollers 215 are arranged alternately in the width direction, and an outer circumference of the rollers are arranged to be partially overlapped viewed from the width direction. The upper rollers 214 and the lower rollers 215 are relatively movable in the vertical direction, that is, the gravity direction, and they are switchable between a closed state in which the sheet S is nipped and conveyed, and an opened state in which the upper rollers 214 and the lower rollers 215 are separated.

Sheet Alignment Operation

Figure 4:
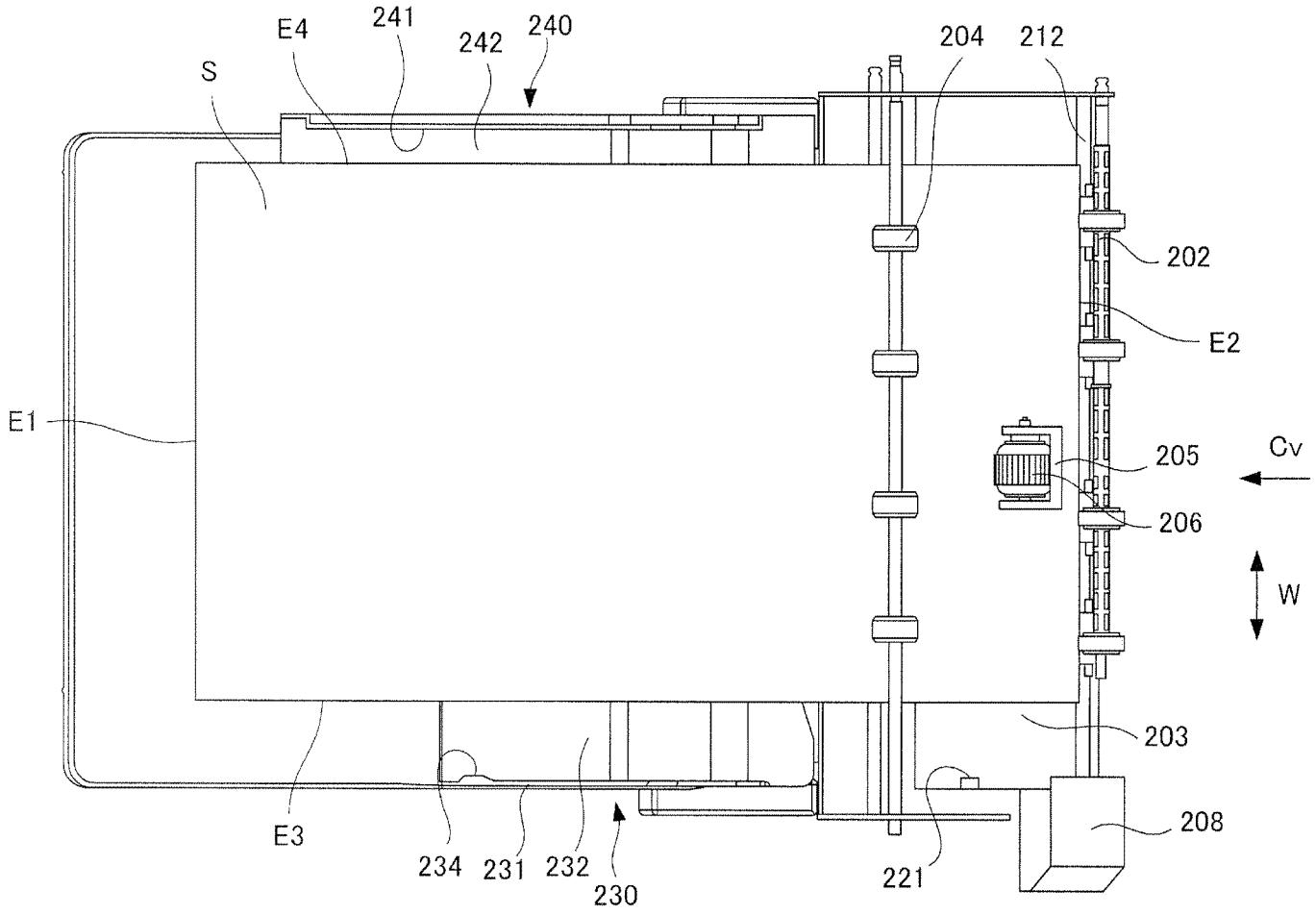
FIG. 4 is a plan view of the sheet alignment device in a first stage of an alignment operation.

A sheet alignment operation according to the sheet alignment device having the above-described configuration will be described with reference to FIGS. 3 and 4. FIGS. 3 and 4 are plan views showing a relevant portion of the sheet processing apparatus 200 from above, and for sake of description, the upper support surfaces 233 and 243 of the widthwise alignment members 230 and 240 are not shown. FIGS. 3 and 4 illustrate a state in which a legal size sheet S is conveyed into the sheet alignment device 210.

In a state where an alignment operation by the sheet alignment device 210 is requested, as illustrated in FIG. 3, the widthwise alignment members 230 and 240 move in advance toward the middle part in the width direction to a position where the lower surface of the sheet S will be supported by the lower support surfaces 232 and 242. At this time, the first alignment member 230 is moved from a retracting position to a position where the third reference wall 234 is aligned with the second reference wall 221 in the width direction. Further, the second alignment member 240 is moved to a position where the distance in the width direction of the lower support surfaces 232 and 242 is set smaller than a width direction length of the sheet S. Then, the sheet alignment device 210 awaits conveyance of the sheet S in a state where the friction roller 206 of the conveyance direction alignment portion 205 is held in the separated position and the sheet discharge roller pair 204 is held in the opened state.

When the sheet S is conveyed by the second the conveyance roller pair 202, the sheet S is supported by the intermediate tray 203 and the widthwise alignment members 230 and 240. In other words, the sheet S is supported by the support surface 213 of the intermediate tray 203 on an upstream side in the conveyance direction, and the sheet S has both side portions in the width direction supported by the lower support surfaces 232 and 242 of the widthwise alignment members 230 and 240 on a downstream side in the conveyance direction.

Figure 5:
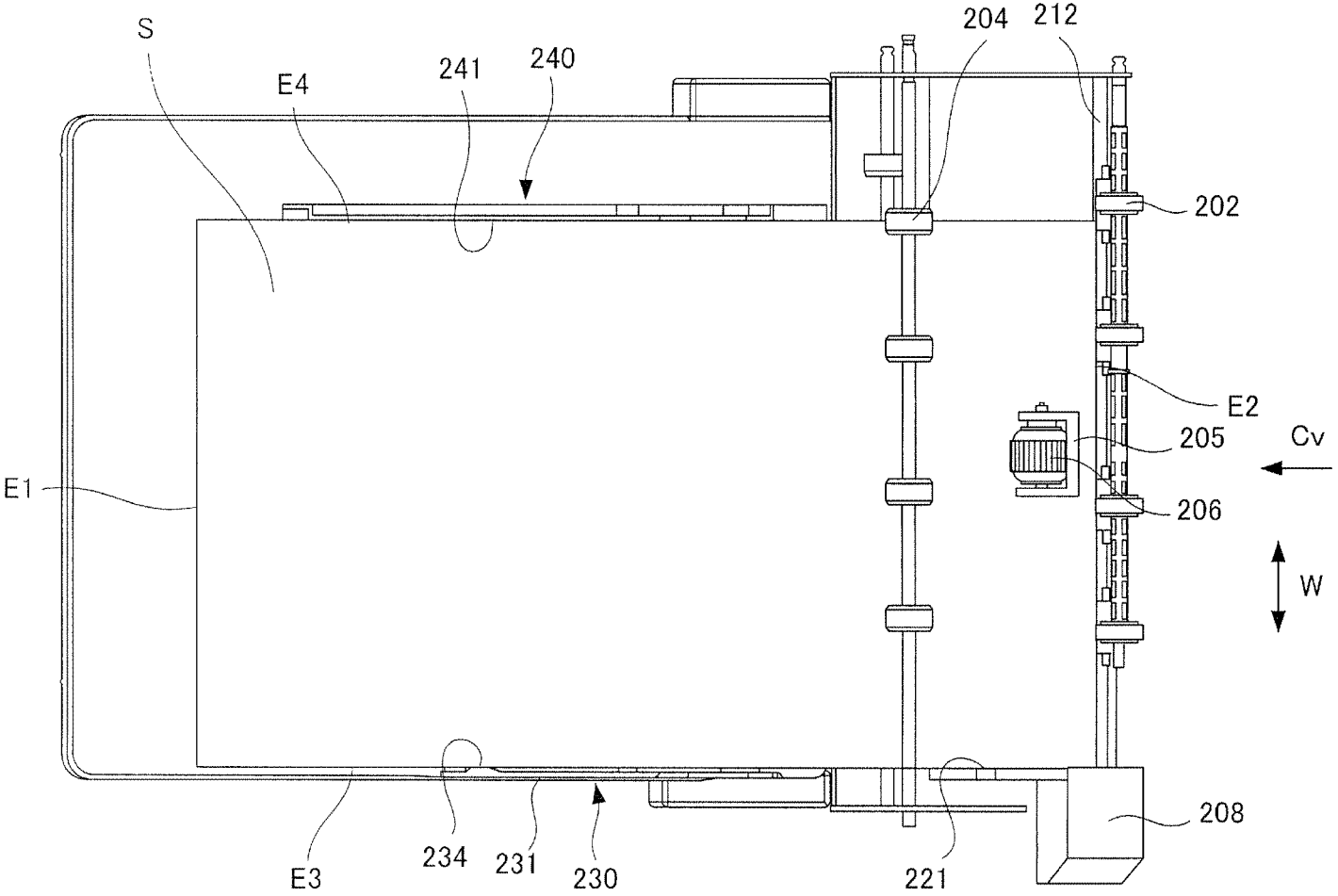
FIG. 5 is a plan view of the sheet alignment device in a second stage of the alignment operation.

In this state, the friction roller 206 of the conveyance direction alignment portion 205 moves to the contact position, and rotates in a direction opposite to the conveyance direction, by which a trailing edge E2 of the sheet S contacts the first reference wall 212 of the intermediate tray 203. Thereafter, the friction roller 206 moves to the separated position, and in a state where the first alignment member 230 is fixed, the second alignment member 240 moves to the width direction toward the first alignment member 230. Thereby, as illustrated in FIG. 5, the contact surfaces 234 and 241 of the widthwise alignment members 230 and 240 are in contact with both side edges E3 and E4 of the sheet S, and the alignment operation of one sheet S is completed. It is noted that a configuration can be adopted where the order of operation of the conveyance direction alignment portion 205 and the widthwise alignment members 230 and 240 are switched, and the sheet S can be aligned in the conveyance direction by the conveyance direction alignment portion 205 in a state where the sheet S is aligned in the width direction by the widthwise alignment members 230 and 240.

In a state where the sheet alignment device 210 aligns a plurality of sheets S, the above-described alignment operation is repeated. In other words, if the alignment operation of a preceding sheet is completed, the sheet alignment device 210 moves the second alignment member 240 to a standby position (refer to FIG. 3), and waits for conveyance of a succeeding sheet. A holding member capable of holding the sheet S together with the support surface 213 of the intermediate tray 203 is arranged near the second reference wall 221, and the member is configured to hold the sheet S in the aligned state when the second alignment member 240 moves. In a state where the succeeding sheet is conveyed by the second the conveyance roller pair 202, at first, the conveyance direction position of the succeeding sheet is aligned by the friction roller 206, and thereafter, the width direction position of the succeeding sheet is aligned by the widthwise alignment members 230 and 240.

Such alignment operation is performed repeatedly for a predetermined number of sheets S designated as the processing unit by the sheet processing apparatus 200. If a predetermined number of sheets S are aligned, the sheet processing apparatus 200 executes a binding process by the stapler 208 as needed. Thereafter, the sheet discharge roller pair 204 is switched to a closed state, and in a state where the widthwise alignment member 230 is moved to the retracting position, the sheet discharge roller pair 204 rotates, by which the sheet bundle having completed processing is stacked on the sheet discharge tray 209.

If the apparatus is set so that the sheet can be discharged onto the sheet discharge tray 209 of the sheet processing apparatus 200 without performing stapling and other processes, the sheet processing apparatus 200 arranges the sheet discharge roller pair 204 to the closed state, and holds the widthwise alignment members 230 and 240 in the retracting position. If a sheet S is conveyed by the second conveyance roller pair 202 in this state, the sheet S will be discharged onto the sheet discharge tray 209 by the sheet discharge roller pair 204 without being held temporarily on the intermediate tray 203.

The sheet alignment device 210 according to the present embodiment is configured to hold both side portions of the sheet S by the widthwise alignment members 230 and 240 disposed on an outer side of a casing 207 of the sheet processing apparatus 200 and positioned above the sheet discharge tray 209 (refer to FIGS. 1 and 2). Then, the sheet bundle whose processing has been completed is discharged to the sheet discharge tray 209 below the widthwise alignment members 230 and 240 in a state where the widthwise alignment members 230 and 240 are separated in the width direction. Therefore, the space above the sheet discharge tray 209 can be utilized as space for performing processes such as aligning process and binding process of the sheets, and for example, the apparatus can be downsized compared to a configuration in which sheet alignment is performed with the sheets stored inside the casing.

In the above-described alignment operation, the sheet S is aligned toward a front side (FIG. 4) of the sheet processing apparatus 200. Therefore, after alignment operation, the sheet bundle discharged onto the sheet discharge tray 209 by the sheet discharge roller pair 204 is stacked at a more front side area of the sheet discharge tray 209, such that the accessibility of the sheet bundle by the user is improved, and the usability is enhanced. Further, as illustrated in FIGS. 3 and 4, the length of the first alignment member 230 in the conveyance direction is set smaller than the second alignment member 240. In other words, an arrangement is adopted in which a downstream end of the second alignment member 240 in the conveyance direction is further extended downstream in the conveyance direction than the first alignment member 230, and the first alignment member 230 is retracting upward in FIG. 4 compared to the second alignment member 240. This configuration enables to prevent the user's hand from interfering with the first alignment member 230 positioned on the front side of the sheet processing apparatus 200, by which the usability can be improved.

Detailed Configuration of Alignment Member

Figure 31:
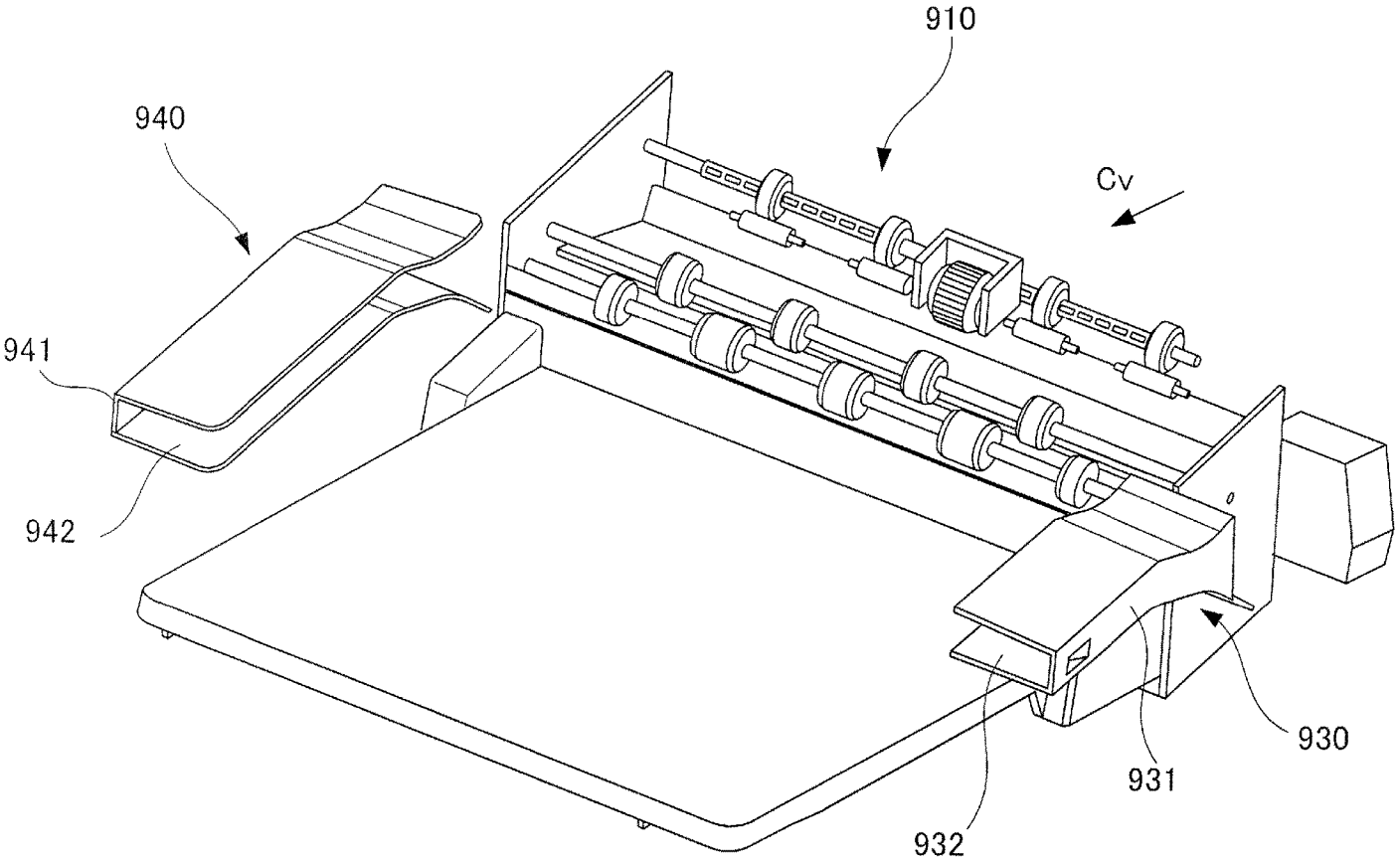
FIG. 31 is a perspective view illustrating a configuration of a sheet alignment device for comparison.
Figure 32:
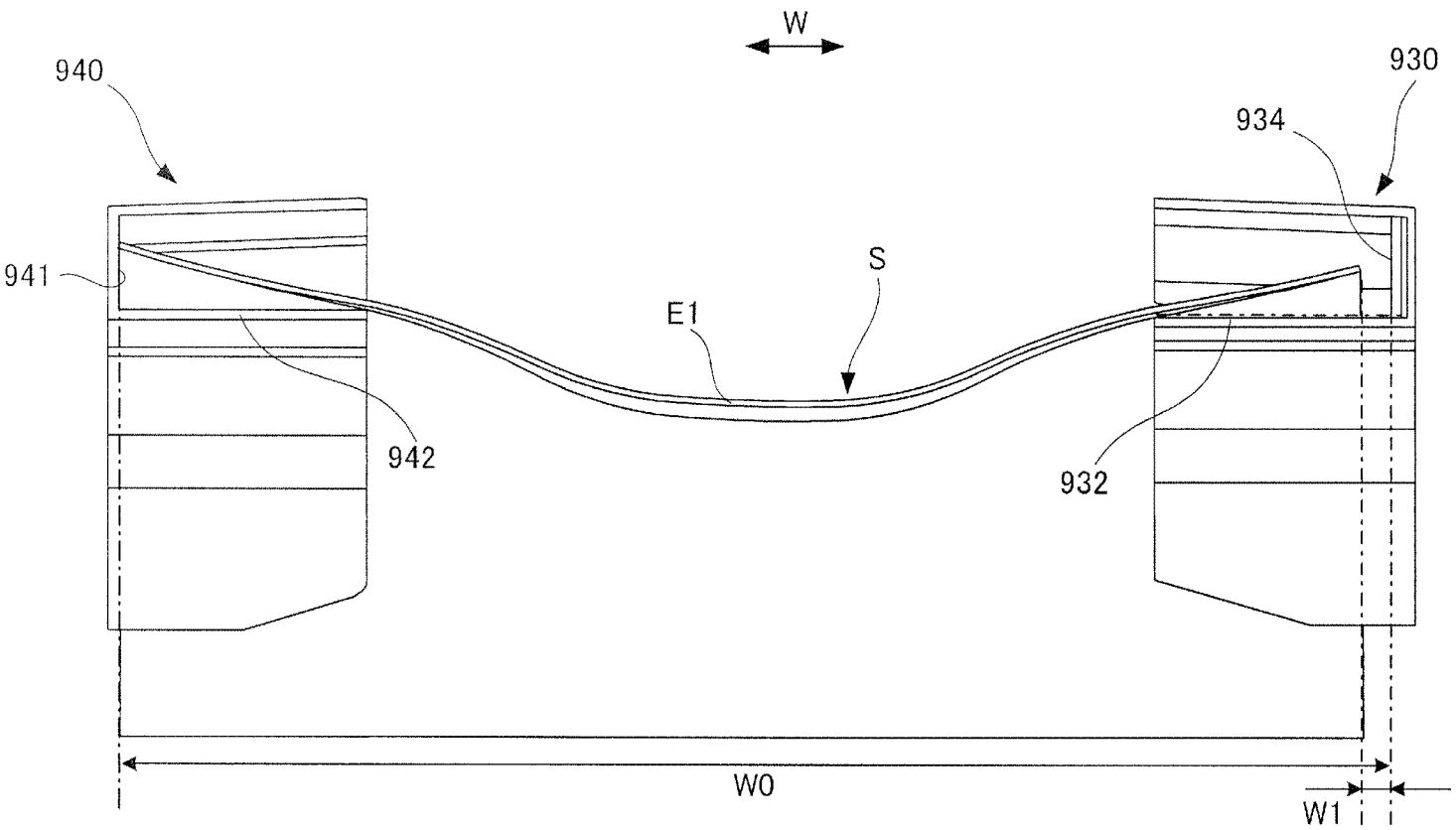
FIG. 32 is a side view illustrating a shape of the widthwise alignment member according to the sheet alignment device for comparison.

Next, a phenomenon that may occur in the configuration of holding both side portions of the sheet by the widthwise alignment members, and a detailed configuration of the widthwise alignment members 230 and 240 according to the present embodiment will be described. As illustrated in FIG. 31 as a sheet alignment device 910 for comparison, lower support surfaces 932 and 942 of widthwise alignment members 930 and 940 were conventionally approximately arranged on a same plane along the width direction. That is, as illustrated in FIG. 32, the two lower support surfaces 932 and 942 were substantially arranged on a same straight line in a plane perpendicular to the conveyance direction.

However, according to this configuration, there were cases where the sheet S was in a sagged state such that the middle portion of the sheet S was curved downwards between the widthwise alignment members 930 and 940 by the weight of the sheet itself or by the sheet being curled as a result of the image forming operation. If such sagging occurs, regardless of the widthwise alignment members 930 and 940 having moved to the alignment position based on width direction length W0 of the sheet, the side edge E3 of the sheet S may not be in contact with an alignment reference wall 934 of a first alignment member 930. As a result, the sheet S was misaligned by a distance corresponding to a gap W1 from the alignment target position, and the alignment accuracy of the sheet S by the sheet alignment device 910 was deteriorated. Further, if stapling was performed in a state where the sheet S is misaligned from the alignment target position, there was a possibility that the positions of the sheets are misaligned within the sheet bundle being bound.

Figure 6:
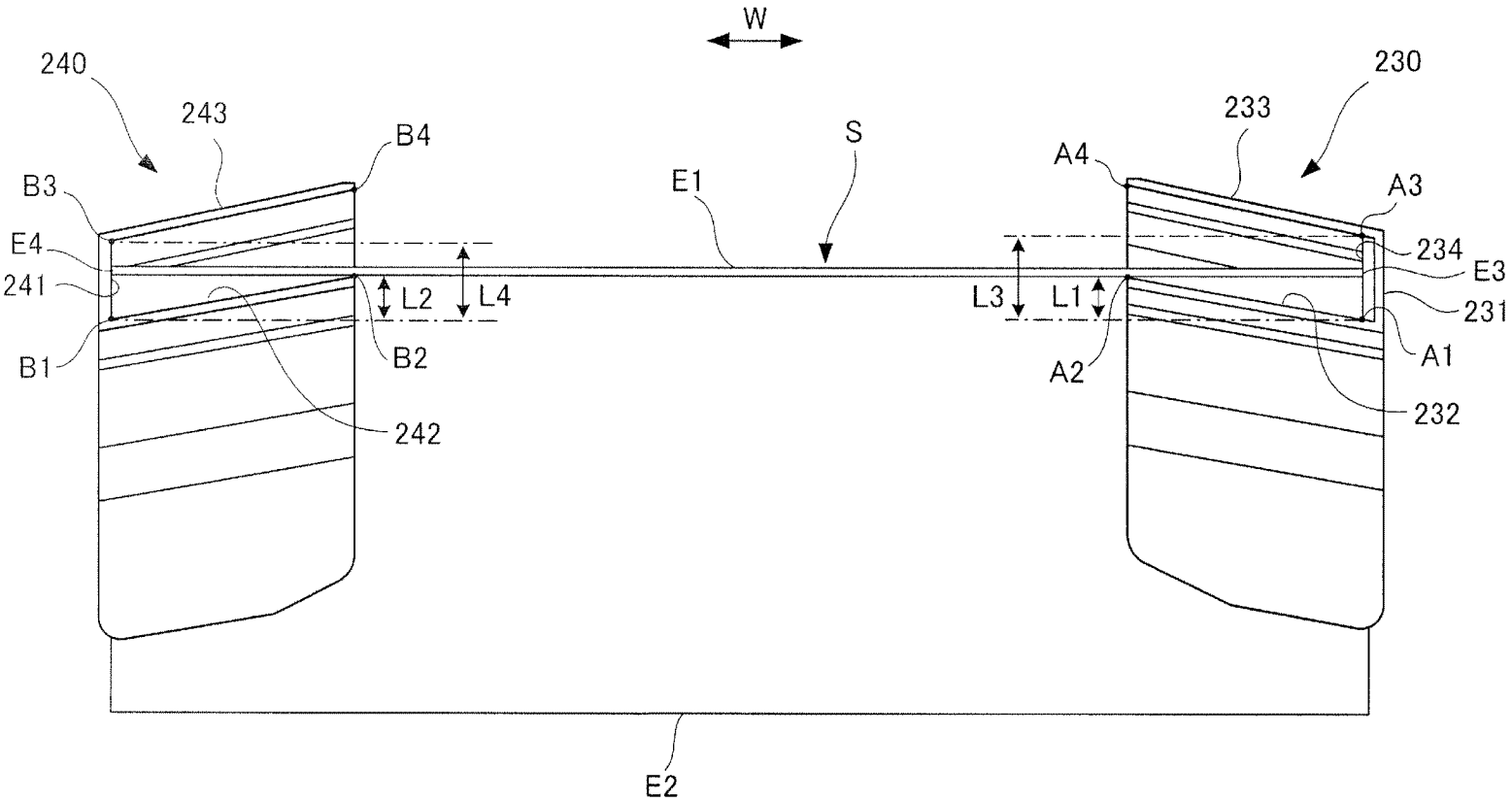
FIG. 6 is a side view illustrating a shape of an alignment member in a width direction viewed from a downstream side in a direction of conveyance of the sheet.
Figure 7:
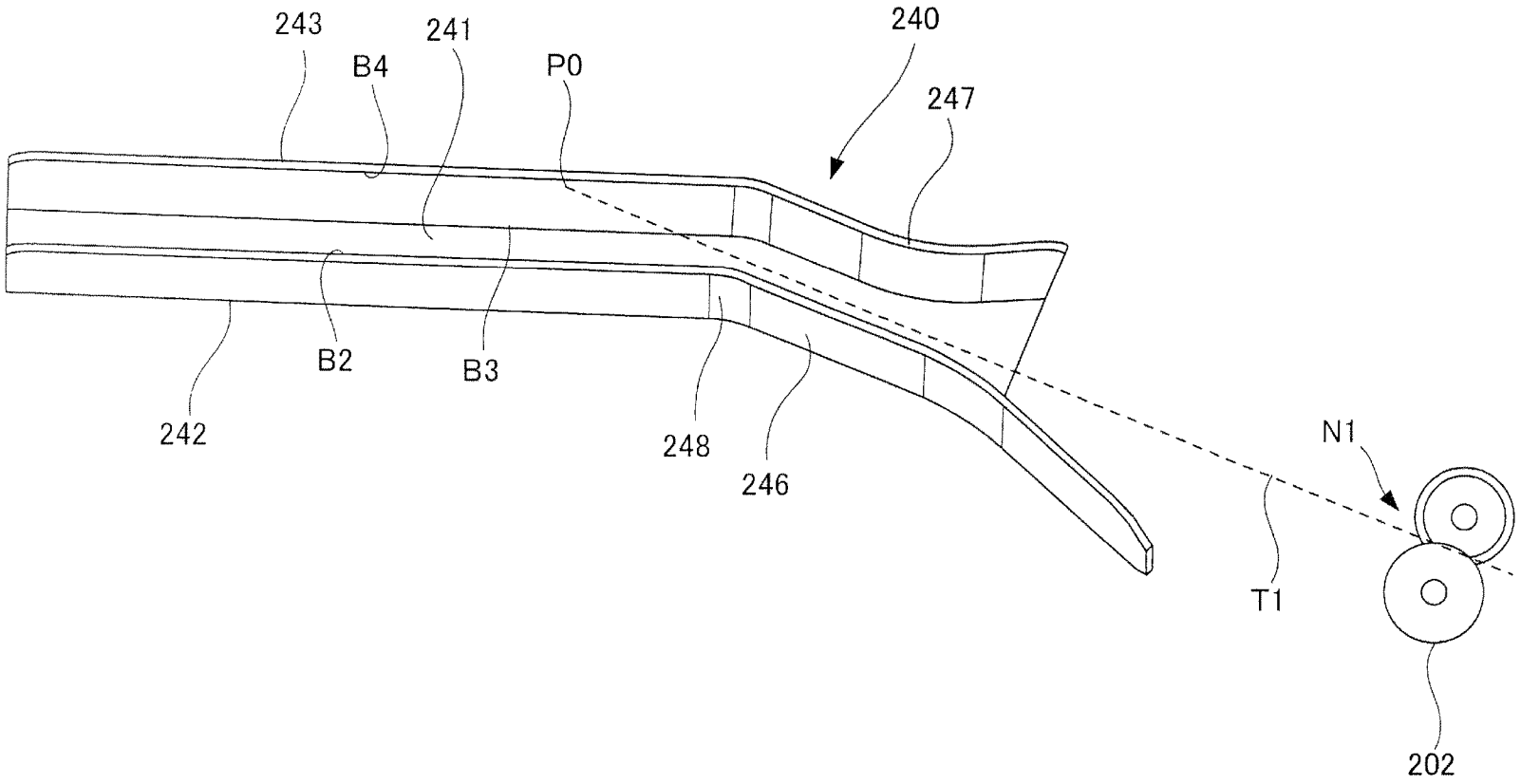
FIG. 7 is a side view illustrating a shape of the alignment member in the width direction viewed in the width direction.
Figure 8:
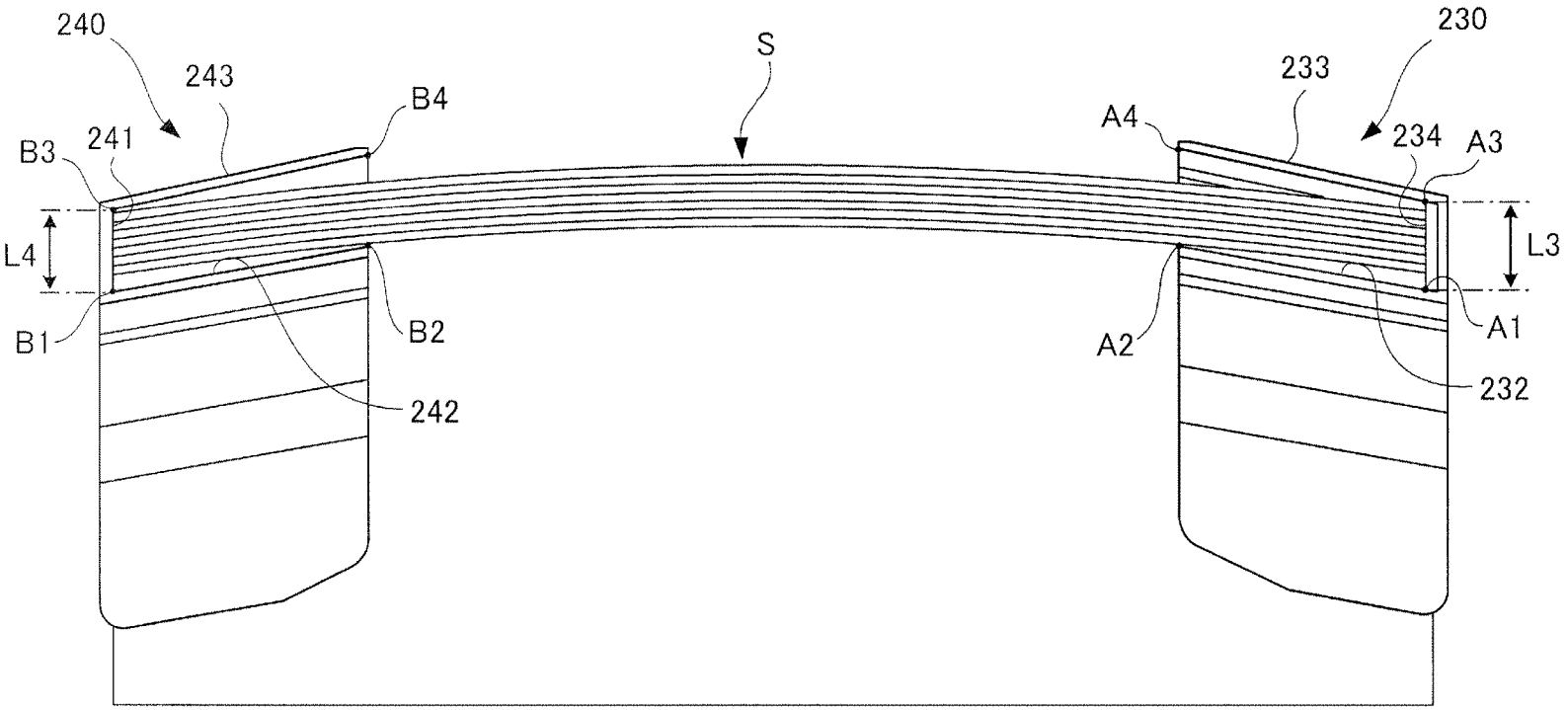
FIG. 8 is a side view illustrating the alignment member in the width direction in a state holding a maximum number of sheets.

Based on insights described above, according to the present embodiment, the lower support surfaces 232 and 242 of the widthwise alignment members 230 and 240 are inclined to suppress downward sagging of the sheet S. Now, with reference to FIGS. 6 through 8, the shapes and operations of the widthwise alignment members 230 and 240 will be described. FIGS. 6 and 8 are side views of the widthwise alignment members 230 and 240 taken from a downstream side in the conveyance direction, that is, direction of arrow X1 in FIGS. 1 and 2, and FIG. 6 illustrates a state where one sheet is held, while FIG. 8 illustrates a state where a maximum number of sheets are held. A maximum number of sheets is a value set as a number of sheets that can be aligned simultaneously by the widthwise alignment members 230 and 240 at the maximum, and for example, the number is set to approximately 30 in the case of normal paper. FIG. 7 is a schematic view illustrating a positional relationship between the second alignment member 240 and the second the conveyance roller pair 202 viewed from a front side of the apparatus in the width direction.

As illustrated in FIG. 6, the lower support surfaces 232 and 242 of the widthwise alignment members 230 and 240 are inclined upward toward the middle part in the width direction in a plane orthogonal to the conveyance direction.

Similarly, the upper support surfaces 233 and 243 of the widthwise alignment members 230 and 240 are also inclined to be approximately in parallel with the opposing lower support surfaces 232 and 242. In other words, as for each of the pair of alignment members, the lower support surfaces 232 and 242 serving as first and second lower surfaces and the upper support surfaces 233 and 243 serving as the first and second upper surfaces are inclined so as to be further upward as it extends toward the other alignment member in the width direction.

In the following description, in the lower support surfaces 232 and 242, the end portions adjacent to the third reference wall 234 or the side wall 241 serving as contact surfaces are referred to as first end portions A1 and B1, and end portions on the inner side in the width direction of the lower support surfaces 232 and 242 are referred to as second end portions A2 and B2. Further, in the upper support surfaces 233 and 243, the end portions adjacent to the third reference wall 234 or the side wall 241 are referred to as third end portions A3 and B3, and end portions on the inner side in the width direction of the upper support surfaces 233 and 243 are referred to as fourth end portions A4 and B4.

If one sheet S is held by the widthwise alignment members 230 and 240 under the inclination of the above-mentioned lower support surfaces 232 and 242, as illustrated in FIG. 6, the lower surface of the sheet S is mainly supported by the second end portions A2 and B2 of the lower support surfaces 232 and 242. Meanwhile, the side edges E3 and E4 of the sheet S are held to or below a height of an upper end position of the third reference wall 234 and the side wall 241 serving as contact surfaces by the third end portions A3 and B3 of the upper support surfaces 233 and 243. Therefore, the second end portions A2 and B2 function as first and second lower portions that respectively support the lower surface of the sheet that is in contact with the first and second contact surfaces of the alignment member. Further, the third end portions A3 and B3 are positioned closer to the first and second contact surfaces than the first and second lower portions in the width direction, and serve as first and second upper portions that hold the upper surface of the sheet in contact with the first and second contact surfaces.

The widthwise alignment members 230 and 240 according to the present embodiment are configured so that a lower portion supporting the lower surface of the sheet, i.e., lower surface holding portion, and an upper portion supporting the upper surface of the sheet, i.e., upper surface holding portion, are arranged substantially linearly in a plane perpendicular to the conveyance direction. In other words, regarding each of the pair of alignment members, a distance between upper and lower portions in the vertical direction, i.e., gravity direction, is set to be at least smaller than a vertical length of the contact surface. Specifically, regarding the first alignment member 230, the distance between the second end portion A2 and the third end portion A3 in the vertical direction is set shorter by difference L1 of height between the second end portion A2 and the first end portion A1 than a vertical length L3 of the third reference wall 234. Further, as for the second alignment member 240, the distance between the second end portion B2 and the third end portion B3 in the vertical direction is set such that it is shorter by difference L2 of height between the second end portion B2 and the first end portion B1 than a vertical length L4 of the side wall 241.

According to this configuration, the sheet S held by the widthwise alignment members 230 and 240 has the lower surface supported by the second end portions A2 and B2 and has the upper surface held by the third end portions A3 and B3 at the outer side in the width direction. Therefore, upward displacement of the side edges E3 and E4 of the sheet S with respect to the second end portions A2 and B2 is restricted, and the sagging of the sheet S in the downward direction is suppressed. Thereby, the alignment accuracy of the sheet alignment device 210 can be improved.

Further, as illustrated in FIG. 7, an upper support surface 243 of the second alignment member 240 is positioned upward than a nip portion N1 of the second the conveyance roller pair 202, and a tangent line T1 at the nip portion N1 intersects with the upper support surface 243 viewed from the width direction. That is, the second conveyance roller pair 202 is arranged to convey the sheet S from a lower side toward the upper support surface 243. Along therewith, inclined surfaces 246 and 247 inclined upward toward the downstream direction in the conveyance direction are provided at the upstream portion of the lower support surface 242 and the upper support surface 243 in the conveyance direction, and a downstream portion of the lower support surface 242 extends in an angle that differs from the upstream inclined surface 246 with respect to a horizontal direction. That is, the lower support surface 242 includes a curved portion 248 curved between the inclined surface 246 and the downstream portion thereof, and can support a sheet curved downward toward a downstream side in the conveyance direction viewed from the width direction. In FIG. 7, the second alignment member 240 is illustrated, but the upper support surface 233 of the first alignment member 230 is similarly arranged upward than the nip portion N1, and arranged such that the tangent line T1 at the nip portion N1 intersects with the upper support surface 233 viewed from the width direction.

According to this arrangement, a leading edge E1 of the sheet S conveyed along the tangent line T1 from the conveyance roller pair 202 contacts the upper support surfaces 233 and 243 near an intersection point P0 between the tangent line T1 and the upper support surfaces 233 and 243 viewed from the width direction. Then, by receiving downward reaction force from the upper support surfaces 233 and 243, the sheet S is conveyed in a curved state where the angle approximates a horizontal direction at a downstream side than the intersection point P0. According to such curvature, a geometrical moment, or second moment, of inertia of the sheet S in the plane perpendicular to the width direction increases, such that the sagging of the sheet S in the downward direction can be suppressed more effectively.

As illustrated in FIG. 8, the upper support surfaces 233 and 243 of the widthwise alignment members 230 and 240 are inclined along an angle of inclination of the corresponding lower support surfaces 232 and 242 in the plane perpendicular to the conveyance direction. Further, lengths L3 and L4 in the vertical direction of the third reference wall 234 and the side wall 241 serving as contact surfaces are set to values greater than a thickness of the sheet bundle including a maximum number of sheets that can be aligned by the widthwise alignment members 230 and 240. Therefore, in a state where a number of sheets S close to a maximum number of sheets are held by the widthwise alignment members 230 and 240, the sheets S are loosely warped upward such that the side portion of the sheets S are arranged along the angle of inclination of the lower support surfaces 232 and 242 and the upper support surfaces 233 and 243.

Now, a comparison configuration is considered in which the lower support surfaces 232 and 242 and the upper support surfaces 233 and 243 are not inclined as according to the present embodiment, but instead, are arranged substantially on a same flat plane when viewed from the conveyance direction, and configured such that the distance between the lower support surface and the upper support surface in the vertical direction is minimized. Even according to such configuration, the distance between the lower portion, i.e., the second end portions A2 and B2, and the upper portion, i.e., the third end portions A3 and B3, in the vertical direction is reduced, and an effect of suppressing downward sagging of the sheet S is expected. However, according to this configuration, the distance between the lower support surface and the upper support surface is reduced compared to the present embodiment, and the maximum number of sheets that can be aligned by the widthwise alignment member is undesirably reduced.

Further, as another possible comparison configuration, the area in which sagging of the sheet S may occur is reduced by extending the lower support surface in the width direction compared to the present embodiment. However, according to such configuration, the distance of movement of the widthwise alignment member to be separated from the sheet bundle having been aligned is increased, and hinders the attempt to enhance the processing speed of the sheet processing apparatus. Furthermore, since a widthwise alignment member having a width-direction size greater than the present embodiment is arranged above the sheet discharge tray, the accessibility of the sheet discharge tray may be deteriorated.

In contrast, according to the configuration of the present embodiment, the inclination of the lower support surfaces 232 and 242 and the upper support surfaces 233 and 243 enables to ensure the maximum number of sheets that can be aligned by the widthwise alignment member while suppressing sagging of the sheet S in the downward direction. Further, since there is no need to extend the widthwise alignment members 230 and 240 in the width direction, it becomes possible to prevent the processing speed and accessibility of the sheet discharge tray from being negatively influenced while suppressing sagging of the sheet S in the downward direction.

In the present embodiment, the second end portions A2 and B2 disposed as the lower portions are positioned somewhat lower than the third end portions A3 and B3 disposed as the upper portions (refer to FIG. 6), but it is also possible to adopt a configuration where the second end portions A2 and B2 are arranged at a position equal to or higher than the third end portions A3 and B3. That is, a configuration can be adopted in which an upward warp is formed to the sheet S in a state where the widthwise alignment members 230 and 240 are holding the first sheet S.

According further to the present embodiment, the respective alignment members 230 and 240 are configured such that the distance between the upper portions (A3 and B3) and the lower portions (A2 and B2) in the vertical direction is set smaller than the length of the contact surface in the vertical direction. It is noted that, if even one of the pair of alignment members adopts such configuration, sagging of the sheet S in the downward direction is expected to be suppressed. According to the present embodiment, both alignment members 230 and 240 adopt such configuration to effectively suppress sagging of the sheet S in the downward direction.

Further, the positional relationship between the second end portions A2 and B2 and the third end portions A3 and B3 is set based on a tolerance of the amount of sagging set based on a maximum value of sheet length and sheet type that the sheet alignment device 210 corresponds to. That is, as the intersection position of straight lines drawn from the third end portions A3 and B3 toward the corresponding second end portions A2 and B2 in a plane perpendicular to the conveyance direction rises, the sagging of the sheet S to the downward direction is regulated more strongly. As an example of the sheet alignment device to which the configuration of the present embodiment is applied, it was preferable to set the amount of sagging of the sheet S, that is, the distance in the vertical direction between the side edges E3 and E4 and the middle portion, to 5 mm or smaller.

Second Embodiment

Next, a second embodiment according to the present disclosure will be described with reference to FIGS. 9 and 10. According to the sheet alignment device of the present embodiment, the shapes of widthwise alignment members 250 and 260 serving as a pair of alignment members differ from those of the first embodiment. The other elements that are common to the first embodiment are denoted with the same reference numbers as the first embodiment, and descriptions thereof are omitted.

Figure 9:
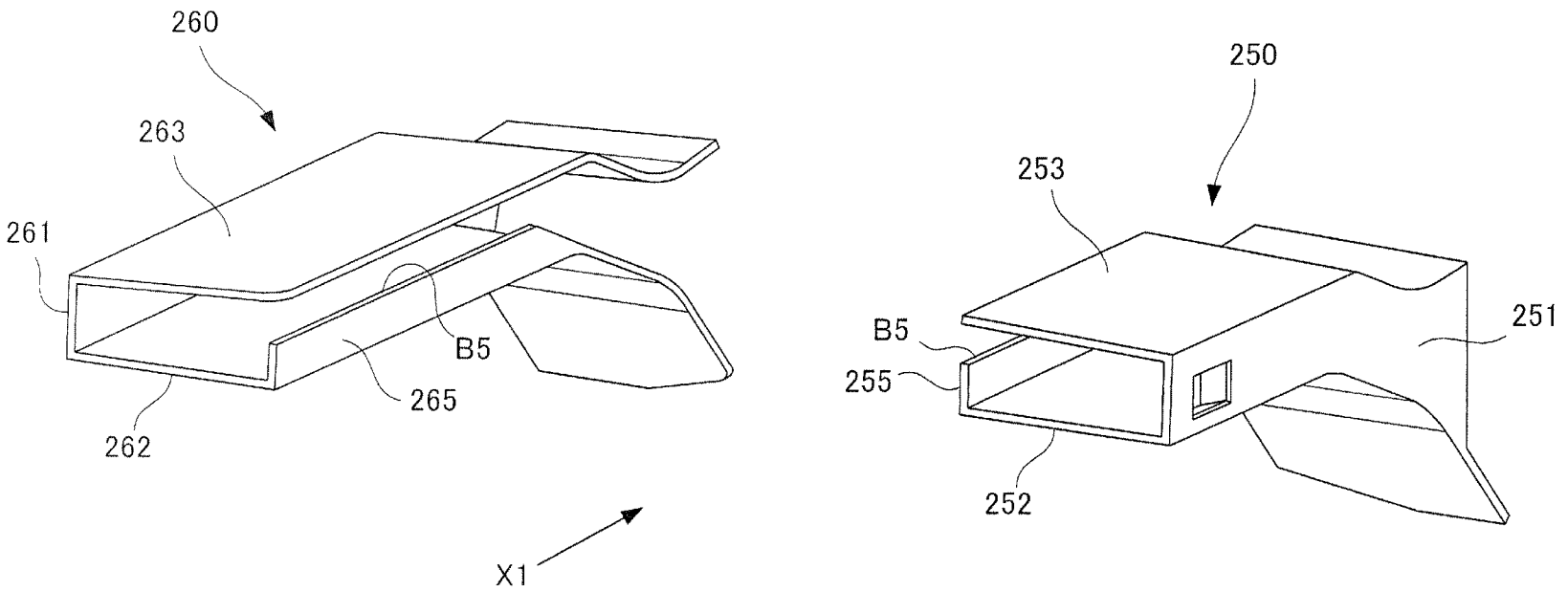
FIG. 9 is a perspective view illustrating a widthwise alignment member according to a second embodiment.
Figure 10:
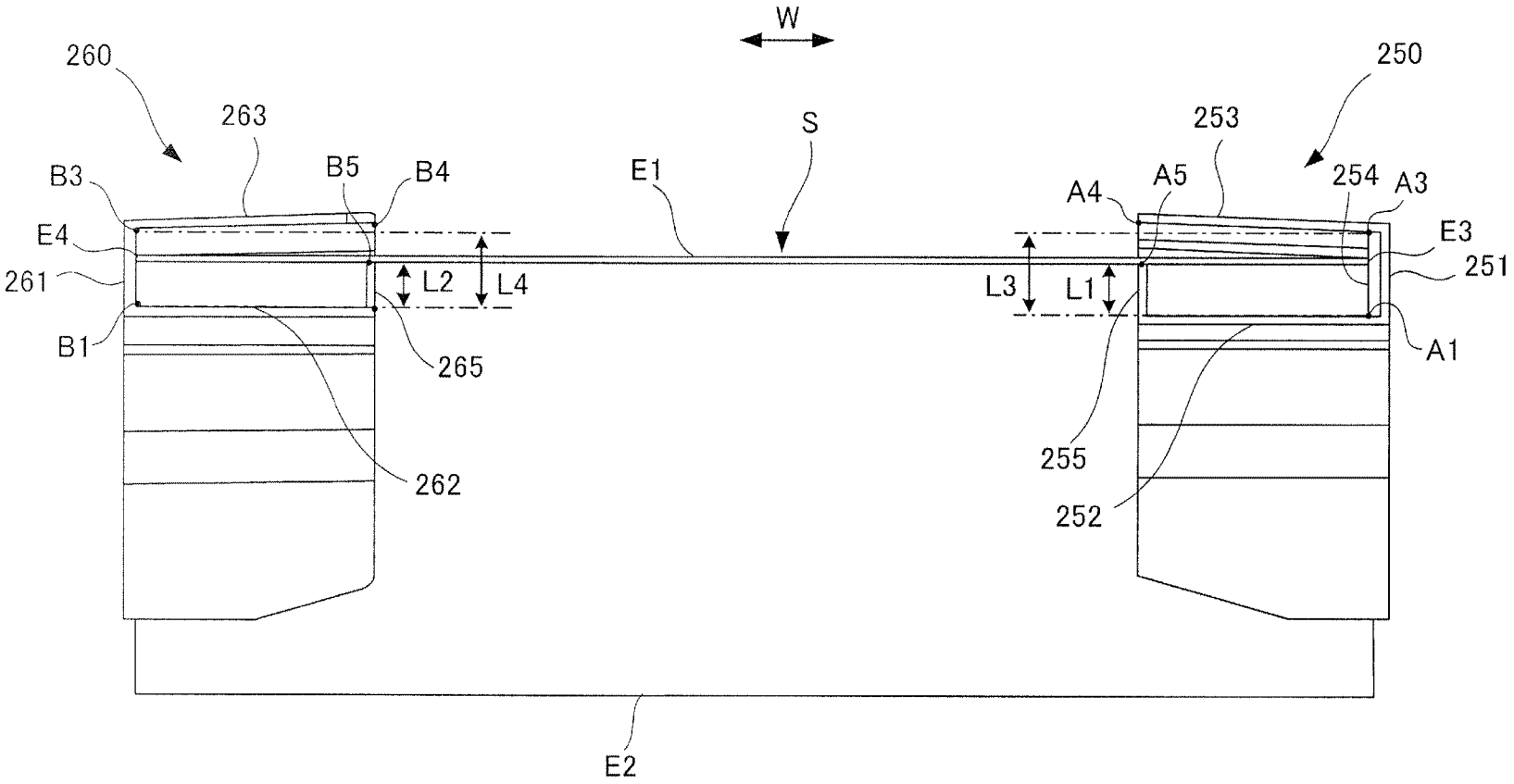
FIG. 10 is a side view illustrating the widthwise alignment member according to the second embodiment viewed from a downstream side in a conveyance direction of a sheet.

As illustrated in FIGS. 9 and 10, widthwise alignment members 250 and 260 according to the present embodiment include a first alignment member 250 arranged on a front side of the sheet processing apparatus 200, and a second alignment member 260 arranged on a back side thereof. The respective alignment members 250 and 260 are equipped with side walls 251 and 261 opposed to the side edges E3 and E4 of the sheet S, and lower support surfaces 252 and 262 and upper support surfaces 253 and 263 that extend from an upper end and a lower end of the side walls 251 and 261 toward the middle part in the width direction. A third reference wall 254 that protrudes from a wall surface toward the back side is provided on a side wall 251 of the first alignment member 250. The third reference wall 254 and the side wall 261 correspond to contact surfaces that contact the sheet S. The lower support surfaces 252 and 262 respectively correspond to first and second lower surfaces opposed to the lower surface of the sheet S in contact with the first and second contact surfaces, and the upper support surfaces 253 and 263 respectively correspond to first and second upper surfaces opposed to the upper surface of the sheet S in contact with the first and second contact surfaces.

The respective alignment members 250 and 260 include ribs 255 and 265 as projecting portions that protrude upward from the lower support surfaces 252 and 262. Then, as illustrated in FIG. 10, upper end portions A5 and B5 of the respective ribs 255 and 265 are arranged to be aligned linearly with the third end portions A3 and A4 at an end portion on the outer side in the width direction of the upper support surfaces 253 and 263 in a plane perpendicular to the conveyance direction. That is, in the first alignment member 250, the distance between the upper end portion A5 and the third end portion A3 of the rib 255 in the vertical direction is set to be smaller by a difference in height L1 between the upper end portion A5 and the first end portion A1 than a length L3 in the vertical direction of the third reference wall 254. Further, regarding the second alignment member 260, the distance between the upper end portion B5 and the third end portion B3 of the rib 265 in the vertical direction is set smaller by a difference in height L2 between the upper end portion B5 and the first end portion B1 compared to a length L4 in the vertical direction of the side wall 261.

According to this configuration, the sheet S held by the widthwise alignment members 230 and 240 has the lower surface supported by the upper end portions A5 and B5 of the ribs 255 and 265 while having the upper surface held by the third end portions A3 and B3 from the outer side in the width direction. Therefore, the displacement toward the upper direction of the side edges E3 and E4 of the sheet S with respect to the upper end portions A5 and B5 is regulated, and the sagging of the sheet S in the downward direction is suppressed. Thereby, the alignment accuracy of the sheet alignment device can be improved.

Moreover as illustrated in FIG. 10, the upper support surfaces 253 and 263 of the respective alignment members 250 and 260 are inclined upward toward the middle part in the width direction. Therefore, the distance between the upper end portion and the fourth end portions A4 and B4 of the ribs 255 and 265 can be ensured compared to the configuration in which the upper support surfaces 253 and 263 are formed approximately parallel with the lower support surfaces 252 and 262. Accordingly, the sagging of the sheet S to the downward direction can be suppressed while ensuring a maximum number of sheets that can be aligned by the widthwise alignment member.

Third Embodiment

Next, a third embodiment of the present disclosure will be described with reference to FIGS. 11 through 14. A sheet alignment device according to the present embodiment differs from the first embodiment in that support plates 275 and 285 serving as movable members are arranged on widthwise alignment members 270 and 280 serving as a pair of alignment members. The other elements that are common to the first embodiment are denoted with the same reference numbers as the first embodiment, and descriptions thereof are omitted.

Figure 11:
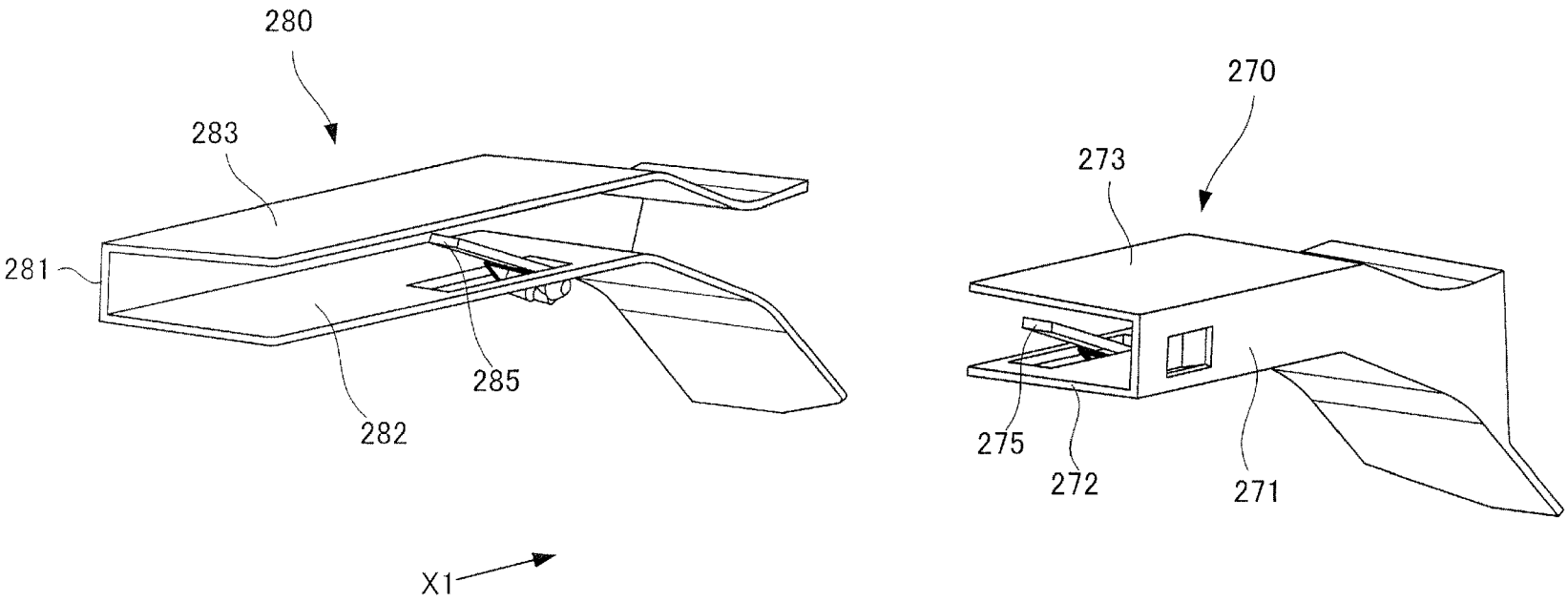
FIG. 11 is a perspective view illustrating a widthwise alignment member according to a third embodiment.

As illustrated in FIG. 11, the widthwise alignment members 270 and 280 according to the present embodiment includes a first alignment member 270 arranged on a front side of the sheet processing apparatus 200, and a second alignment member 280 arranged on a back side thereof. The respective alignment members 270 and 280 are equipped with side walls 271 and 281 that oppose to the side edges E3 and E4 of the sheet S, and lower support surfaces 272 and 282 and upper support surfaces 273 and 283 that extend from upper and lower ends of the side walls 271 and 281 toward the middle part in the width direction. A third reference wall 274 (refer to FIG. 13) protruding from the wall surface toward the back side is provided on the side wall 271 of the first alignment member 270. The third reference wall 274 and the side wall 281 correspond to contact surfaces that contact the sheet S. The lower support surfaces 272 and 282 respectively correspond to the first and second lower surfaces opposed to the lower surface of the sheet S in contact with the first and second contact surfaces, and the upper support surfaces 273 and 283 respectively correspond to the first and second upper surfaces opposed to the upper surface of the sheet S in contact with the first and second contact surfaces.

Figure 12A:
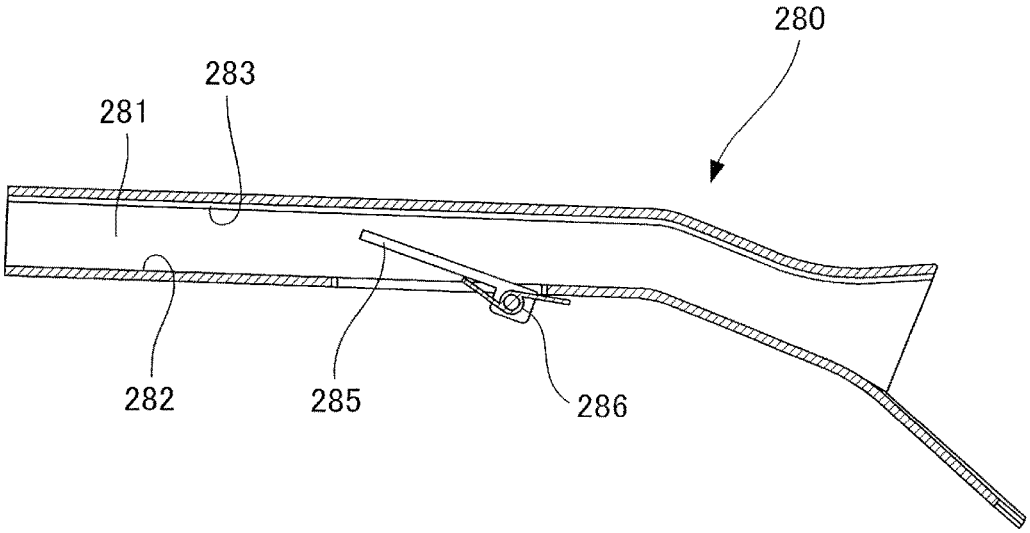
FIG. 12A is a cross-sectional view illustrating a configuration of the widthwise alignment member according to the third embodiment.
Figure 12B:
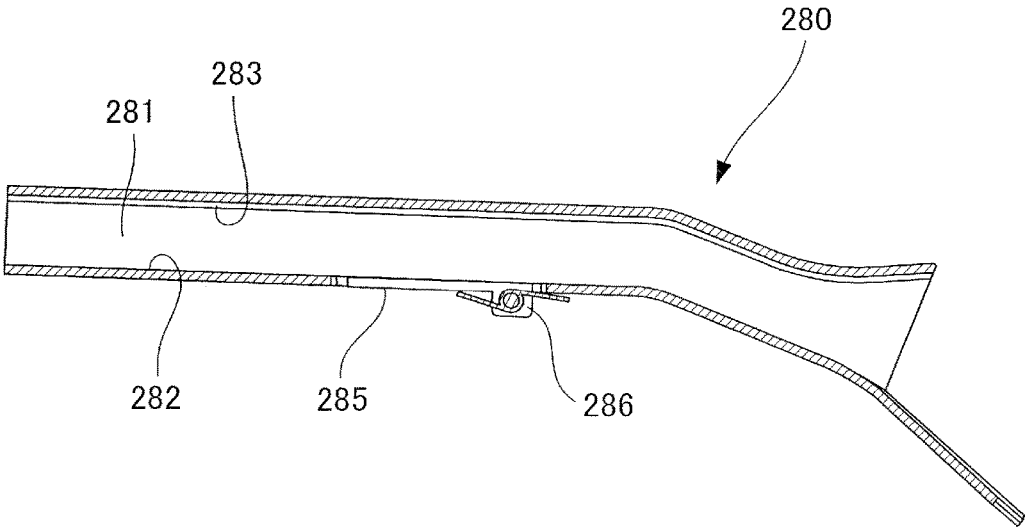
FIG. 12B is a cross-sectional view illustrating a configuration of the widthwise alignment member according to the third embodiment.

The support plates 275 and 285 that can move in the vertical direction with respect to the lower support surfaces 272 and 282 are attached respectively to the alignment members 270 and 280. As illustrated in FIG. 12A, the support plate 285 is a plate-like member disposed pivotably around an end portion on an upstream side in the conveyance direction, and it is urged toward the upper support surface 283 by the torsion coil spring 286. Further, as illustrated in FIG. 12B as a cross-sectional view from the width direction, if a downward external force is applied, the support plate 285 can move to a position in flush surface with the lower support surface 282 against the repulsive force of the torsion coil spring 286. FIGS. 12A and 12B only illustrate the second alignment member 280, but a similar torsion coil spring is arranged on the support plate 275 of the first alignment member 270.

Figure 13:
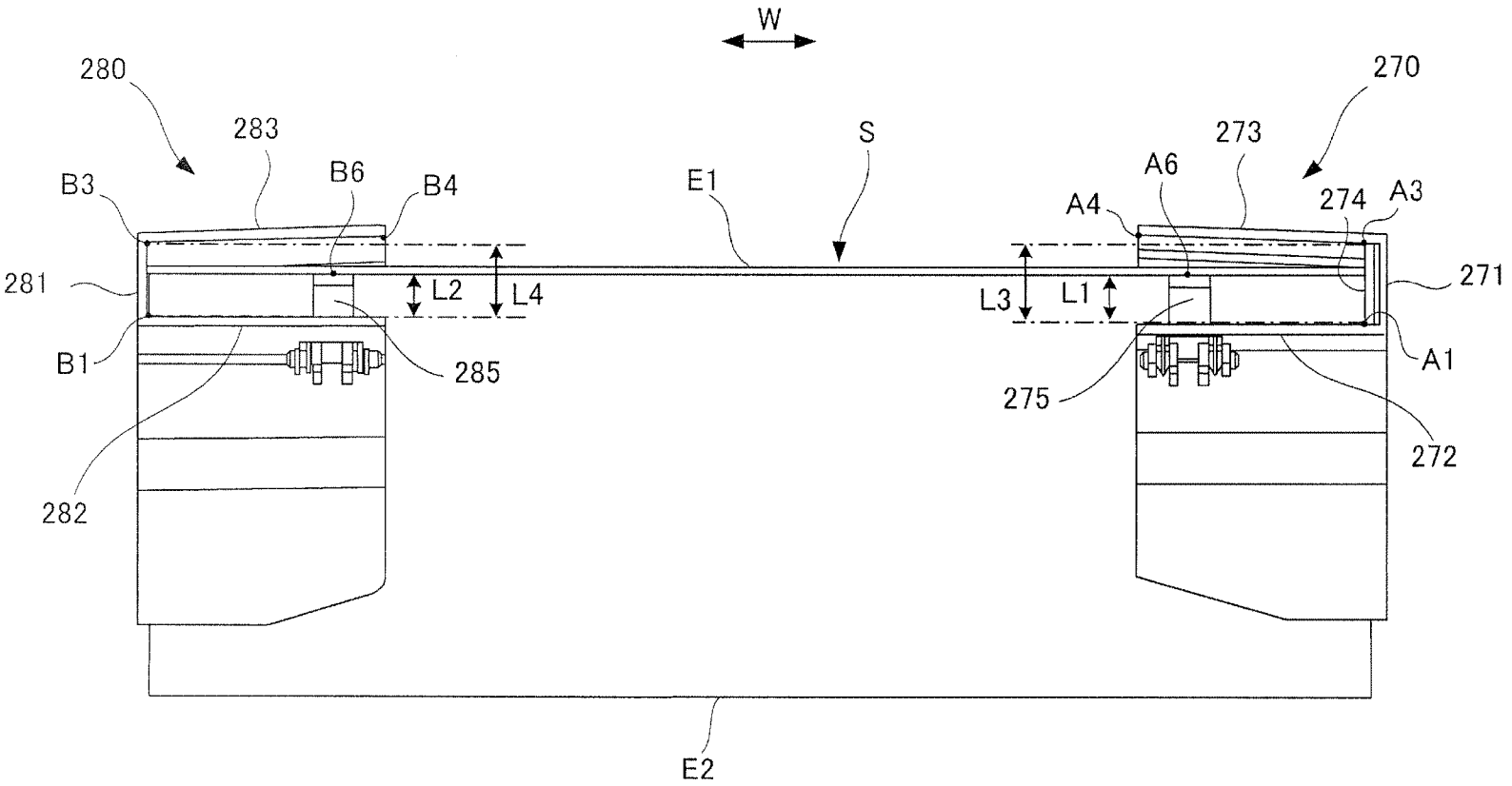
FIG. 13 is a side view illustrating the widthwise alignment member according to the third embodiment viewed from a downstream side in the conveyance direction of the sheet.

As illustrated in FIG. 13, in a state where a number of sheets S equal to or smaller than a fixed number is supported, far end portions A6 and B6 of the respective support plates 285 are arranged to be approximately linearly with the third end portions A3 and A4 which are end portions on the outer side in the width direction of the upper support surfaces 273 and 283 in a plane perpendicular to the conveyance direction. In other words, regarding the first alignment member 270, the distance between the far end portion A6 and the third end portion A3 of the support plate 275 in the vertical direction is set shorter by difference L1 of height between the far end portion A6 and the first end portion A1 than a vertical length L3 of the third reference wall 234. Further, regarding the second alignment member 280, the distance between the far end portion B6 and the third end portion B3 of the support plate 285 in the vertical direction is set shorter by difference L2 of height between the far end portion B6 and the first end portion B1 than the vertical length L4 of the side wall 281.

According to this arrangement, in a state where a relatively small number of sheets S is held by the widthwise alignment members 270 and 280, the lower surface of the sheet S is supported by the far end portions A6 and B6 of the support plates 275 and 285, while the upper surface of the sheet S is held by the third end portions A3 and B3 from the outer side in the width direction. Therefore, the displacement of the side edges E3 and E4 of the sheet S to the upward direction with respect to the far end portions A6 and B6 can be restricted, and the sagging of the sheet S in the downward direction is suppressed. Thereby, the alignment accuracy of the sheet alignment device can be improved.

Figure 14:
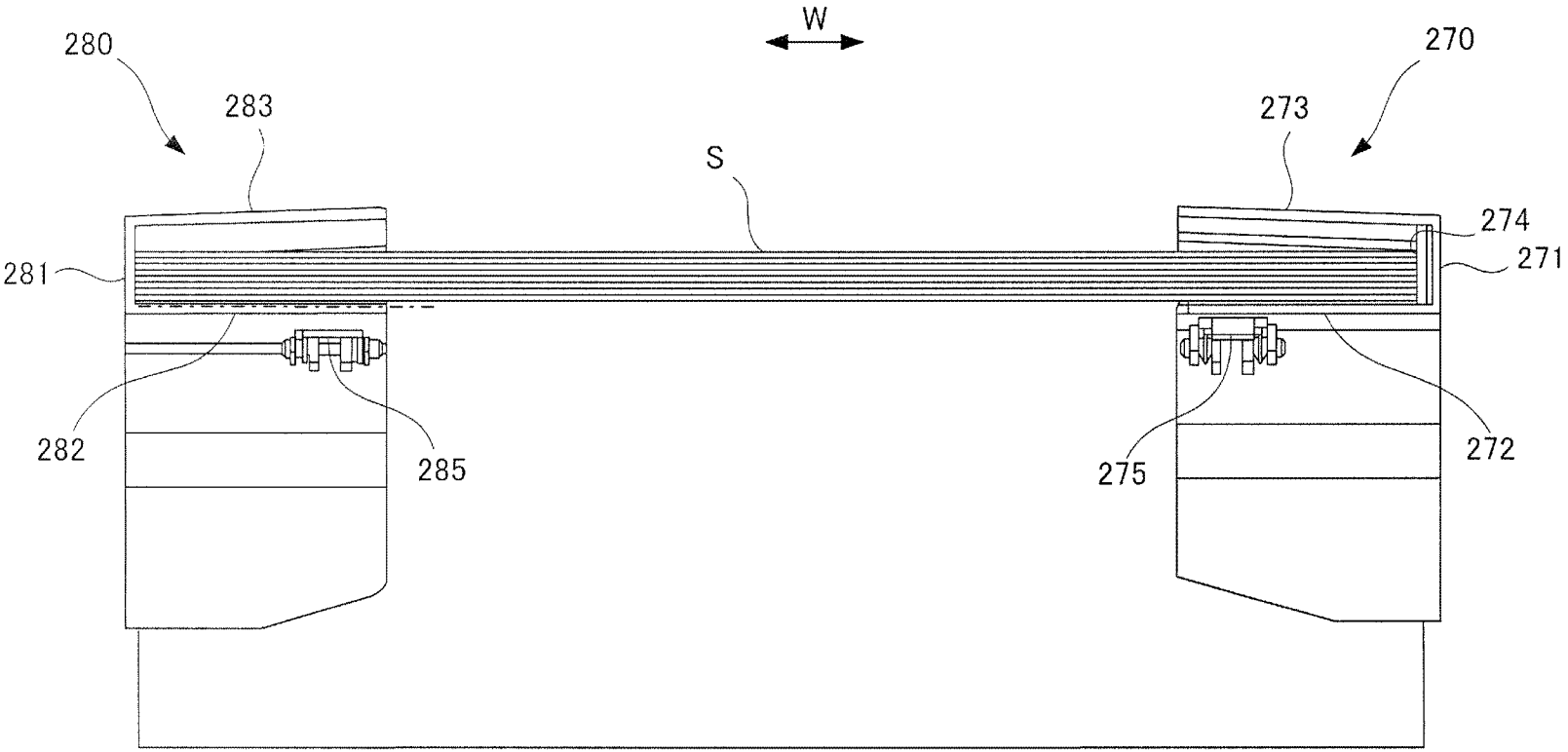
FIG. 14 is a side view of the widthwise alignment member in a state holding the maximum number of sheets.

Further, as illustrated in FIG. 14, spring pressure of the torsion coil spring is set such that if a weight of a certain number of sheets S is applied on the support plates 275 and 285, the support plates 275 and 285 are lowered to the position of the lower support surfaces 272 and 282. Therefore, compared to the configuration in which the position of the support plates 275 and 285 is fixed, the space between the lower support surfaces 272 and 282 and the upper support surfaces 273 and 283 can be utilized as space for supporting the sheets S. That is, the maximum number of sheets that can be aligned by the widthwise alignment members 270 and 280 can be ensured easily.

The torsion coil spring is one example of a unit for urging the movable member toward the upper surface, and other urging units can be used to urge the movable member. For example, a configuration can be adopted where a movable member composed of a flat spring also functions as the urging unit.

Fourth Embodiment

Next, a sheet processing apparatus 200B and an image forming apparatus 1B according to a fourth embodiment will be described with reference to FIGS. 15 and 16. A sheet alignment device 410 according to the present embodiment differs from the first embodiment in that an alignment operation of the sheet is performed in a state where a middle portion of the sheet in the width direction is supported by an intermediate tray 403.

Figure 15:
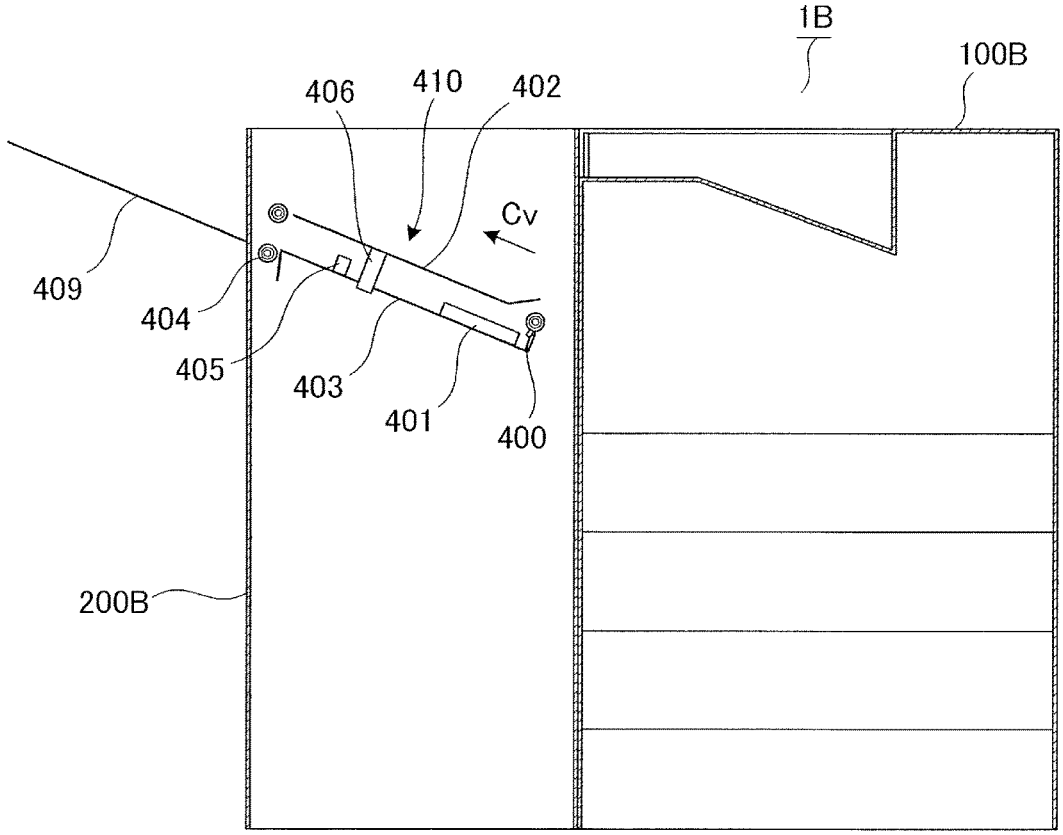
FIG. 15 is a schematic view illustrating a configuration of an image forming apparatus including a sheet alignment device according to a fourth embodiment.

As illustrated in FIG. 15, the image forming apparatus 1B according to the present embodiment comprises an image forming apparatus body 100B equipped with an image forming portion having a similar configuration as the first embodiment, and a sheet processing apparatus 200B attached removably to a side portion of the image forming apparatus body 100B.

The sheet processing apparatus 200B is equipped with the sheet alignment device 410 that aligns sheets received from the image forming apparatus body 100B. The sheet alignment device 410 includes the intermediate tray 403 serving as a supporting portion, an upper guide 402 opposed to the intermediate tray 403 in the vertical direction, a conveyance roller pair 400 serving as a conveyance member, and a widthwise alignment member 401. The conveyance roller pair 400 receives the sheet conveyed from the image forming apparatus body 100B to the sheet processing apparatus 200B, and discharges the sheet to the intermediate tray 403. The widthwise alignment member 401 is a pair of alignment members arranged on both sides in the width direction orthogonal to the conveyance direction of the sheet by the conveyance roller pair 400, and aligns the width direction position of the sheet supported on the intermediate tray 403.

A sheet discharge roller pair 404 serving as a sheet discharge member configured to discharge sheets is arranged downstream of the intermediate tray 403 in the conveyance direction. The sheet discharge roller pair 404 is switchable between a closed state in which the sheet can be nipped and conveyed, and an opened state in which the sheet discharge roller pair is separated from the sheet. The sheet discharge roller pair 404 discharges the sheet bundle aligned by the sheet alignment device 410 and subjected to stapling and other processes by a processing mechanism not shown onto a sheet discharge tray 409.

There were cases as according to the sheet alignment device 410 where the alignment accuracy was deteriorated by the sheet being curved downward, even in a case where the sheet having its middle portion in the width direction supported by the intermediate tray 403 was aligned. That is, the sheet supported on the intermediate tray 403 may be in a curved state due to causes such as shrinkage of resin components constituting the image formed on the sheet, or change in moisture content when the sheet is heated by the fixing unit. Then, in a state where the sheet is curved, even if the widthwise alignment member 401 moves to the alignment position, the alignment member will not be in contact with both side edges of the sheet, and the sheet may be misaligned from the alignment target position.

Figure 16:
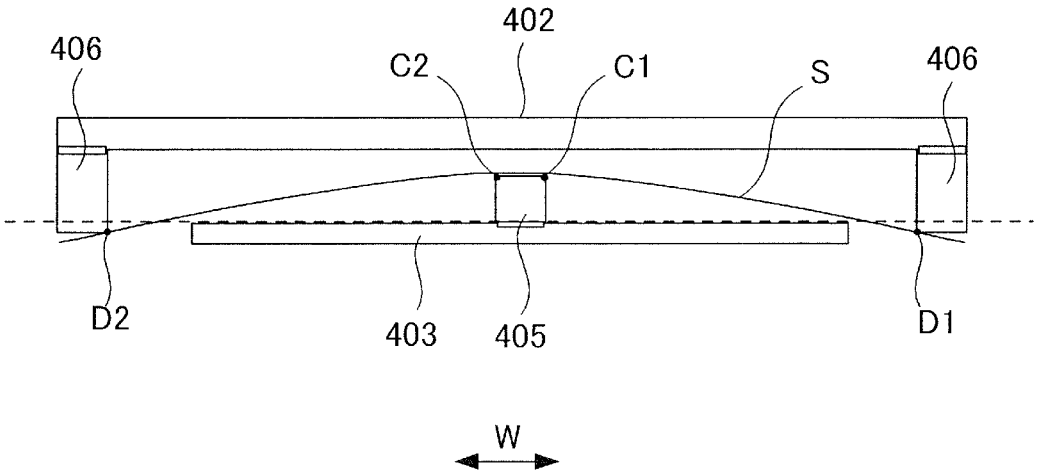
FIG. 16 is a frame format illustrating a relevant portion of the sheet alignment device according to the fourth embodiment.

Therefore, according to the present embodiment, as illustrated in FIGS. 15 and 16, an upper projecting portion 405 projecting upward is provided on the intermediate tray 403, and a lower projecting portion 406 projecting downward is provided on the upper guide 402. In a plane perpendicular to the conveyance direction, upper end portions C1 and C2 of the upper projecting portion 405 are positioned upward than a supporting surface position (dashed line) of the intermediate tray 403, and lower end portions D1 and D2 of the lower projecting portion 406 are protruded below the supporting surface of the intermediate tray 403.

The upper projecting portion 405 is positioned between a pair of widthwise alignment members 401 in the width direction. The lower projecting portions 406 and 406 are arranged on one side and the other side of the upper projecting portion 405 in the width direction. The upper end portions C1 and C2 of the upper projecting portion 405 correspond to lower portions supporting the lower surface of the sheet between a pair of alignment members in the width direction. Further, the lower end portions D1 and D2 of the lower projecting portions 406 and 406 correspond to a pair of upper portions holding the upper surface of the sheet at an outer side of the lower portion in the width direction.

According to this configuration, as illustrated in FIG. 16, the sheet S has the lower surface supported by the upper end portions C1 and C2 of the upper projecting portion 405, while the upper surface is pressed from above by the lower end portions D1 and D2 of the lower projecting portions 406 and 406. Therefore, even if the sheet S having the middle portion curved downward in a state where external force is not applied is conveyed to the sheet alignment device 410, the sheet S is held to a fixed shape viewed from the conveyance direction by the function of the upper projecting portion 405 and the lower projecting portions 406 and 406. Then, by setting the alignment position of the widthwise alignment member 401 to correspond to the shape of the sheet held by the upper projecting portion 405 and the lower projecting portions 406 and 406, the alignment accuracy of the sheet S in the with direction can be improved.

In the present embodiment, the upper and lower portions are described as being arranged on the upper guide 402 and the intermediate tray 403, but the actual configuration of the upper and lower portions is not restricted to the above-described configuration, as long as the sheet S can be held in a fixed shape. For example, if a configuration is adopted where the lower projecting portions 406 and 406 are protruded downward from the supporting surface of the intermediate tray 403 (refer to FIG. 16), the above-described upper projecting portion 405 can be omitted and the supporting surface of the intermediate tray 403 can be set as the upper portion. Further, a configuration can be adopted in which the intermediate tray 403 is curved such that it is projected upward viewed from the conveyance direction, and the upper guide 402 is curved in a corresponding shape. Further according to FIGS. 15 and 16, the upper projecting portion 405 and the lower projecting portion 406 are illustrated in format view as rectangular members, but it is also possible to provide an inclined surface that guides the leading edge of the sheet S to the positions of the end portions C1, C2, D1 and D2 on the upstream side in the conveyance direction.

Fifth Embodiment

Next, a sheet processing apparatus according to a fifth embodiment will be described with reference to FIGS. 17 through 23. According to the present embodiment, the shapes of widthwise alignment members 310 and 320 differ from the widthwise alignment members 230 and 240 according to the first embodiment. The other elements that are common to the first embodiment are denoted with the same reference numbers as the first embodiment, and the descriptions thereof are omitted.

Figure 17:
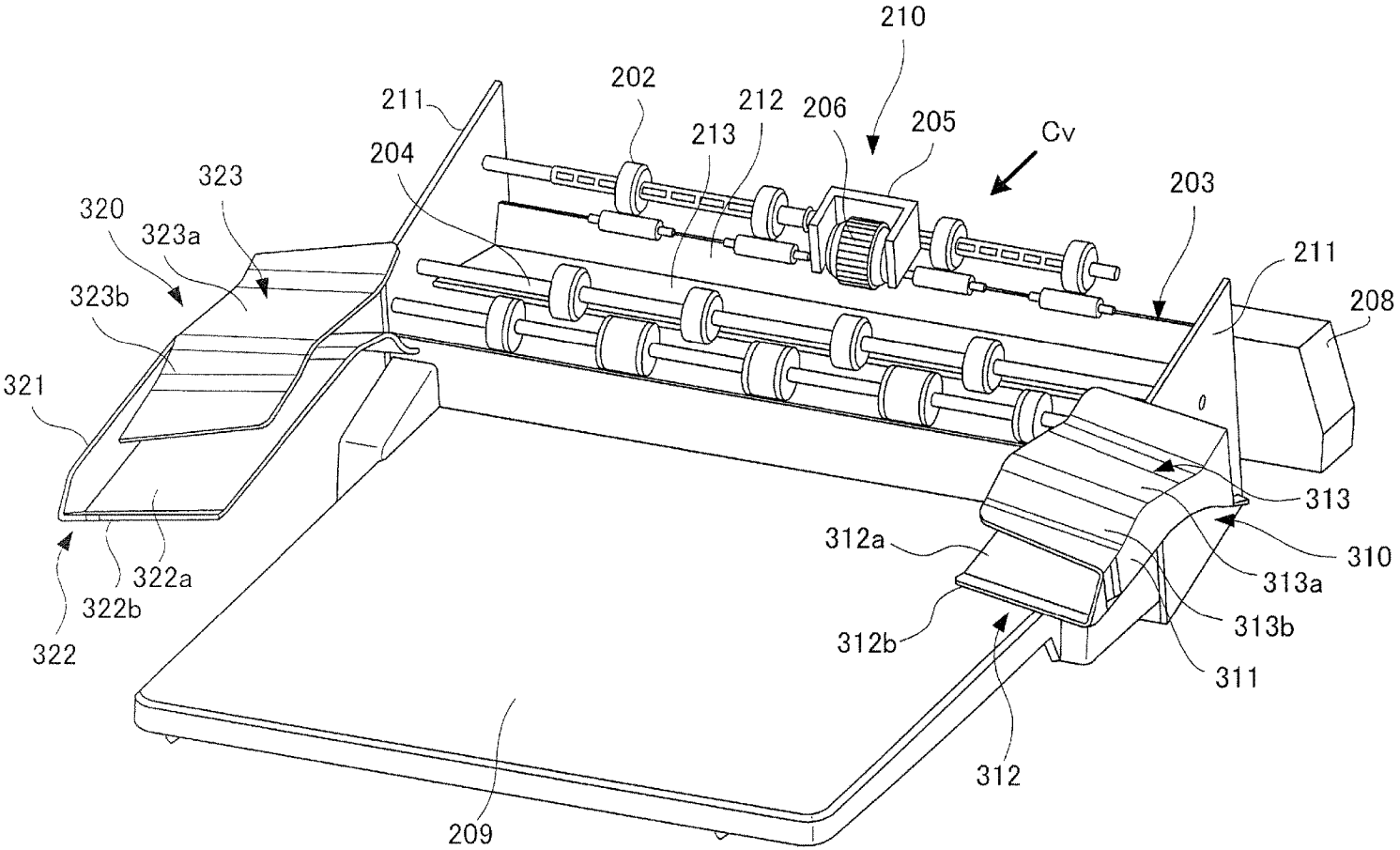
FIG. 17 is a perspective view of a sheet alignment device according to a fifth embodiment.
Figure 18:
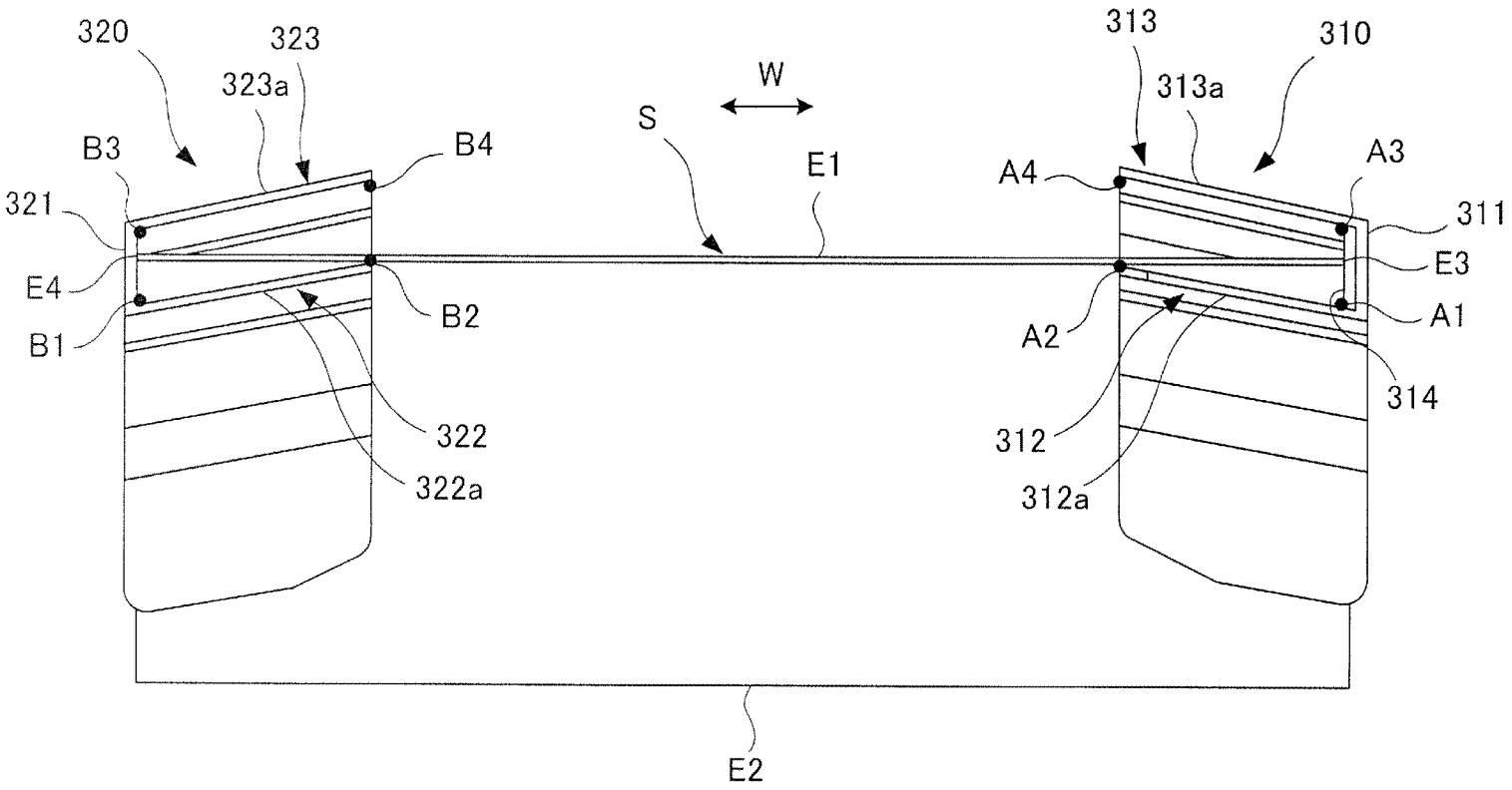
FIG. 18 is a cross-sectional view illustrating a widthwise alignment member according to the fifth embodiment viewed from a downstream side in the conveyance direction of the sheet.

As illustrated in FIG. 17, a first alignment member 310 and a second alignment member 320 are provided as a pair of alignment members arranged on both sides of the sheet alignment device 210 in the width direction. As illustrated in FIG. 18, the respective alignment members 310 and 320 have C-shaped cross-sectional shapes defined by side walls 311 and 321, lower support surfaces 312 and 322, and upper support surfaces 313 and 323. A third reference wall 314 serving as a contact surface that can be in contact with the side edge E3 on one side of the sheet S is arranged on the side wall 311 of the first alignment member 310, and the second alignment member 320 has the side wall 321 function as a contact surface that can be in contact with the other side edge E4 of the sheet.

Similar to the first embodiment, the widthwise alignment members 310 and 320 relatively move in the width direction to contact both side edges E3 and E4 of the sheet S, and align the sheet position in the width direction. According to the present embodiment, similar to the first embodiment, the lower support surfaces 312 and 322 and the upper support surfaces 313 and 323 of the widthwise alignment members 310 and 320 are inclined upward toward the inner side in the width direction. Therefore, the sheet S is held by the second end portions A2 and B2 respectively corresponding to the first and second lower portions and the third end portions A3 and B3 respectively corresponding to the first and second upper portions, and sagging of the sheet S in the downward direction is suppressed. FIG. 18 illustrates a cross-sectional shape of the upstream portion of the widthwise alignment members 310 and 320 in the conveyance direction of the sheet S.

Figure 19:
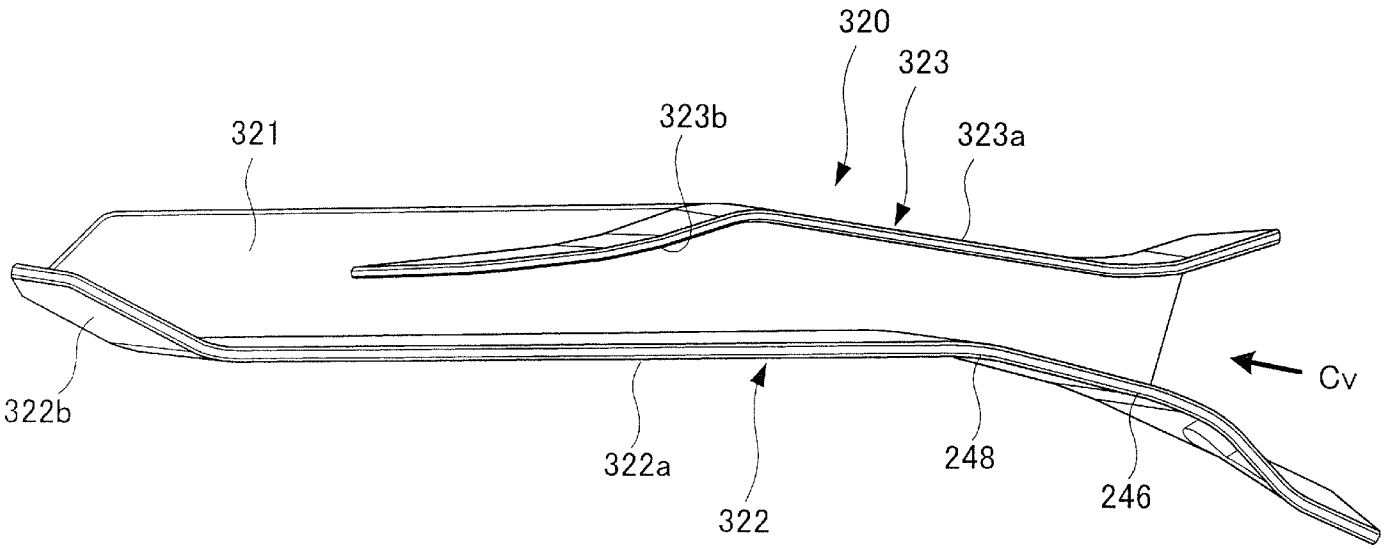
FIG. 19 is a perspective view illustrating one of the widthwise alignment members according to the fifth embodiment.
Figure 20:
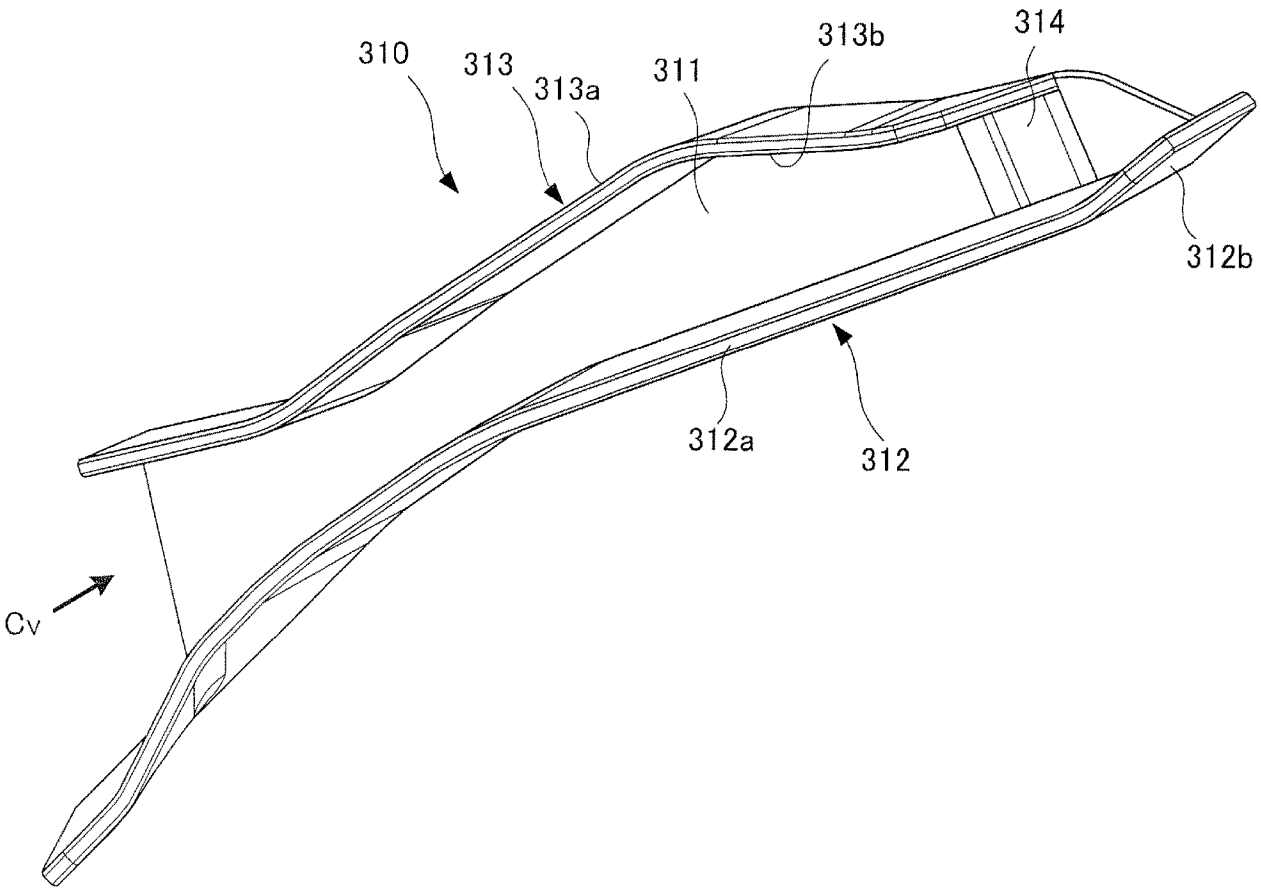
FIG. 20 is a perspective view illustrating the other one of the widthwise alignment members according to the fifth embodiment.

Now, as illustrated in FIGS. 19 and 20, the widthwise alignment members 310 and 320 include inclined surfaces 312*b* and 322*b* inclined upward toward the downstream side in the conveyance direction at the most downstream portion of the lower support surfaces 312 and 322 in the conveyance direction. As illustrated in FIGS. 19 and 20, a lower support surface 312 of the first alignment member 310 includes a first lower surface portion 312*a*, i.e., first portion, opposed to an upper support surface 313, and a second lower surface portion 312*b*, i.e., second portion, positioned downstream of the upper support surface 313 in the conveyance direction. Further, a lower support surface 322 of the second alignment member 320 includes, as first and second portions, a first lower surface portion 322*a* opposed to an upper support surface 323, and a second lower surface portion 322*b* positioned downstream in the conveyance direction than the upper support surface 323. The second lower surface portions 312*b* and 322*b* are extended to an inclined direction such that it is further upward with respect to the corresponding first lower surface portions 312*a* and 322*a* as it extends downstream in the conveyance direction.

Figure 21:
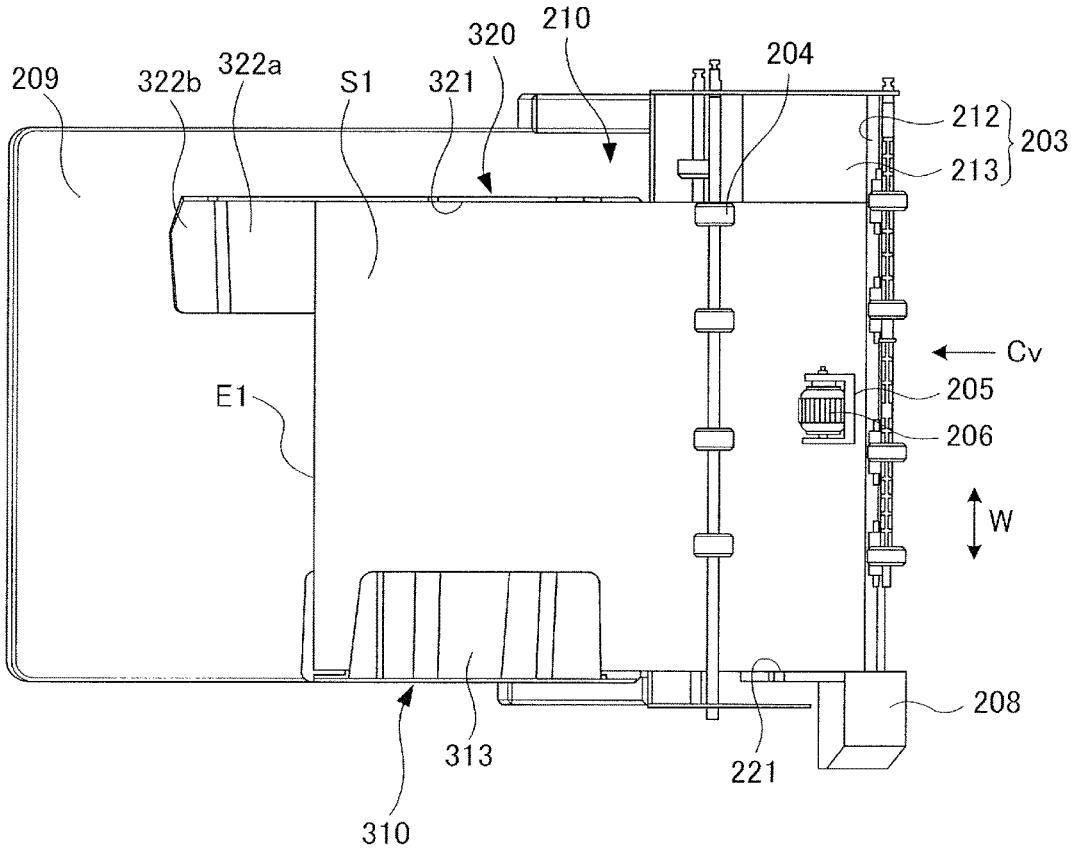
FIG. 21 is an upper view illustrating a state in which a letter size sheet is aligned by the sheet alignment device according to the fifth embodiment.
Figure 22:
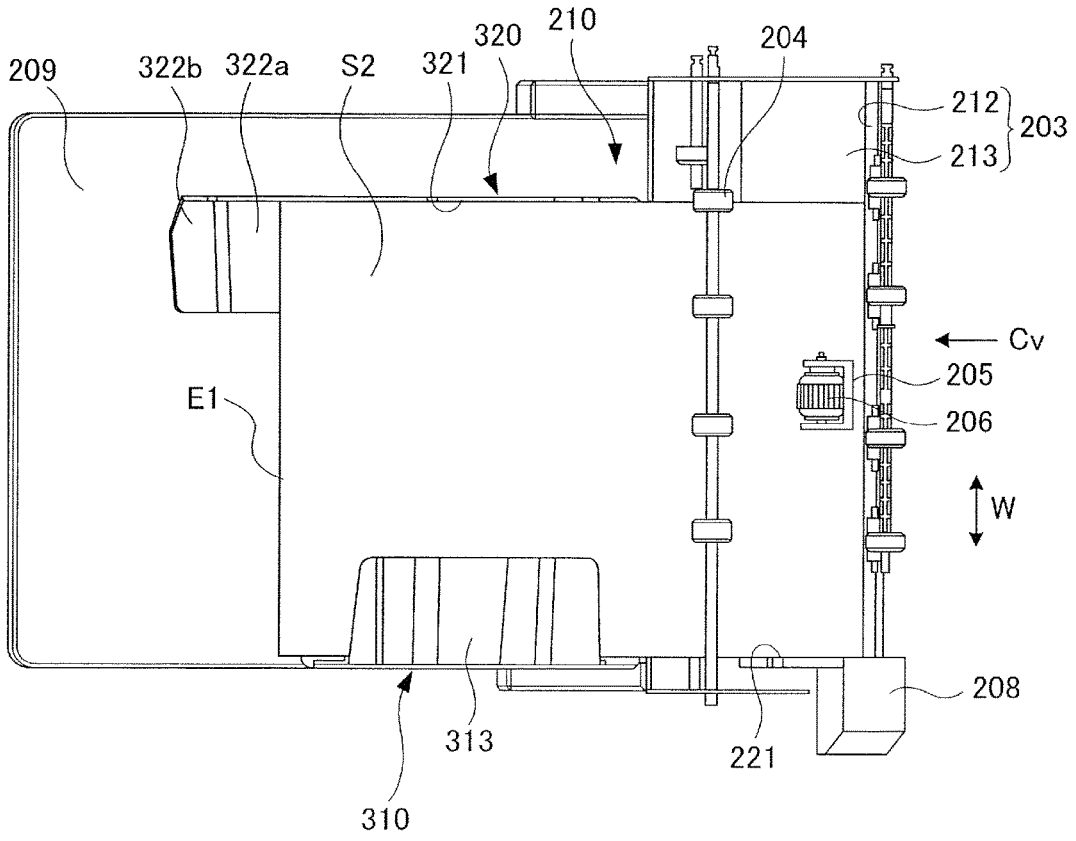
FIG. 22 is an upper view illustrating a state in which an A4 size sheet is aligned by the sheet alignment device according to the fifth embodiment.
Figure 23:
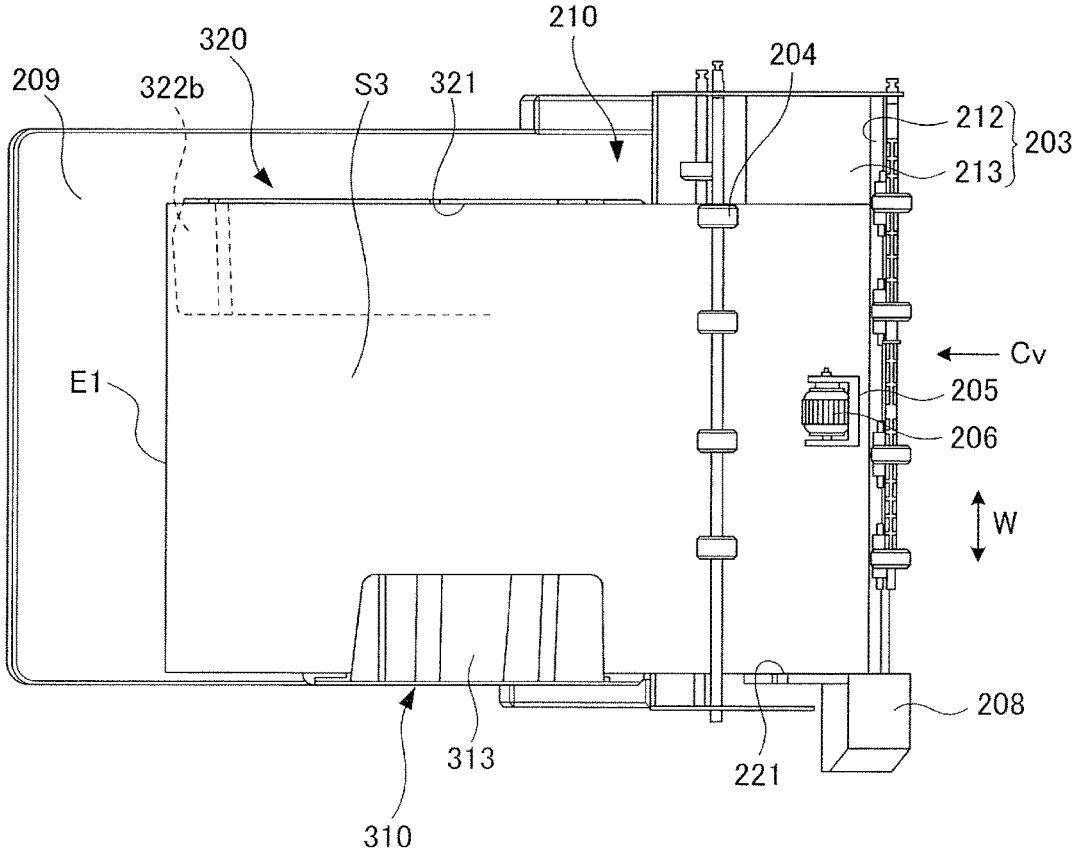
FIG. 23 is an upper view illustrating a state in which a legal size sheet is aligned by the sheet alignment device according to the fifth embodiment.

The function of the second lower surface portions 312*b* and 322*b* will be described with reference to FIGS. 21 through 23. FIGS. 21, 22 and 23 are upper views illustrating a state in which a letter size sheet S1, an A4 size sheet S2 and a legal size sheet S3 are aligned by the sheet alignment device 210. For convenience, the upper support surface 323 of the second alignment member 320 is not illustrated.

As illustrated in FIGS. 21 and 22, in a state where the letter size sheet S1 or A4 size sheet S2 which have a relatively short length in the conveyance direction is aligned, the leading edge E1 of the sheet S1 or S2 is supported by the first lower surface portion 322*a*. In contrast, as illustrated in FIG. 23, if a legal size sheet S3 having a relatively long length in the conveyance direction is aligned, the leading edge E1 of the sheet S3 is projected downstream in the conveyance direction illustrated by arrow Cv from the widthwise alignment members 310 and 320.

According to the present embodiment, the downstream portion of the sheet supported on the intermediate tray 203 is raised up by the second lower surface portions 312*b* and 322*b*. Especially, the downstream portion of the relatively long sheet S3 is raised up by the second lower surface portion 322*b*, according to which the sagging of the leading edge E1 by the own weight of the sheet S is suppressed. Since sagging of the leading edge E1 is suppressed, during conveyance of a sheet bundle by the sheet discharge roller pair 204, the possibility of the leading edge of the sheet bundle being conveyed to be in contact with the sheet already supported on the sheet discharge tray 209 is reduced. Therefore, it becomes possible to prevent the sheets supported on the sheet discharge tray 209 from being pushed outward from the sheet discharge tray 209, or from being misaligned from position. That is, according to the shape of the widthwise alignment members 310 and 320 of the present embodiment, it becomes possible to reduce sagging of the sheet while the sheet is being discharged, and performance of stacking the sheet bundle on the sheet discharge tray 209 can be improved.

It may be possible to consider widening the vertical distance between the widthwise alignment members 310 and 320 and the sheet discharge tray 209 as a configuration enabling to reduce pushing of the sheet during discharge of the sheet bundle, but such a configuration hinders the effort to downsize the apparatus. In contrast, according to the present embodiment, pushing of the sheet is reduced by providing the second lower surface portion 322*b*, and the apparatus can be downsized.

As illustrated in FIGS. 22 and 23, according to the present embodiment, the second lower surface portion 322*b* of the second alignment member 320 is arranged between a leading edge position of A4 size sheet S2 and a leading edge position of legal size sheet S3 with respect to the conveyance direction denoted by arrow Cv. According to this arrangement, it becomes possible to prevent the leading edge E1 of the sheets S2 and S3 from rubbing against the second lower surface portion 322*b* in the course of the alignment operation. That is, if the second lower surface portion 322*b* overlaps the leading edge position of the legal size sheet S3, the leading edge E1 of the sheet S3 may be rubbed strongly against the second lower surface portion 322*b* when the second alignment member 320 moves downward in the drawing during the alignment operation. In contrast, according to the arrangement of the present embodiment, regardless of whether the size of the sheet is letter size, A4 size or legal size, the leading edge E1 is prevented from being in contact with the second lower surface portion 322*b*. Thereby, the durability of the second lower surface portion 322*b* can be improved, and the possibility of the sheet being damaged can be reduced.

Since the first alignment member 310 is a member that does not move during the alignment operation, unlike the second alignment member 320, it is less influenced by the rubbing of the sheet. Therefore, regarding the first alignment member 310, the arrangement of the second lower surface portion 312*b* can be determined regardless of the leading edge position of the sheet. For example, by reducing the overall length of the first alignment member 310 as much as possible with respect to the conveyance direction without extending the second lower surface portion 312*b* more than necessary, the accessibility of the sheet discharge tray 209 can be ensured. Further, the above-mentioned A4 size and legal size are examples of a first standard size and a second standard size, i.e., first and second sizes, to which the sheet alignment device 210 corresponds, and the arrangement of the second lower surface portion 322*b* can be changed arbitrarily to correspond to other standard sizes. For example, a configuration can be adopted where the second lower surface portion 322*b* is positioned between a leading edge position of a B4 size sheet and a leading edge position of an A3 size sheet with respect to the conveyance direction.

According further to the present embodiment, first upper surface portions 313*a* and 323*a* and second upper surface portions 313*b* and 323*b* inclined with respect to the first upper surface portions 313*a* and 323*a* are provided on the upper support surfaces 313 and 323 (refer to FIGS. 19 and 20). The first upper surface portions 313*a* and 323*a* are positioned above the tangent line T1 passing the nip portion of the second conveyance roller pair 202 viewed from the width direction (refer to FIG. 7), and extend approximately in the direction along the tangent line T1. The second upper surface portions 313*b* and 323*b* extend toward the downstream side in the sheet conveyance direction from the first upper surface portions 313*a* and 323*a*, and are inclined in a direction intersecting with the tangent line T1. The respective second upper surface portions 313*b* and 323*b* are arranged upstream in the conveyance direction than the second lower surface portions 312*b* and 322*b* of the corresponding lower support surfaces 312 and 322, and are inclined such that the distance between the lower support surfaces 312 and 322 in the vertical direction reduces toward the downstream side in the conveyance direction.

According to this arrangement, the sheet conveyed from the conveyance roller pair 202 is curved such that the leading edge side of the sheet is sagged downward by the leading edge of the sheet being in contact with the second upper surface portions 313*b* and 323*b* or by the own weight of the sheet. By this curvature, the geometrical moment of inertia of the sheet in a plane vertical to the width direction is increased, and the sagging of the sheet S in the downward direction can be suppressed more effectively. Further, in the case of a relatively long sheet, the sheet bundle has the lower surface supported by the second lower surface portions 312*b* and 322*b* in a state where the upper surface is held by the second upper surface portions 313*b* and 323*b*. Therefore, the effect of reducing sagging of the sheet bundle by the second lower surface portions 312*b* and 322*b* can be enhanced.

Now, the shape of the second alignment member 320 will be described in further detail with reference to FIGS. 24 through 26.

Figure 24:
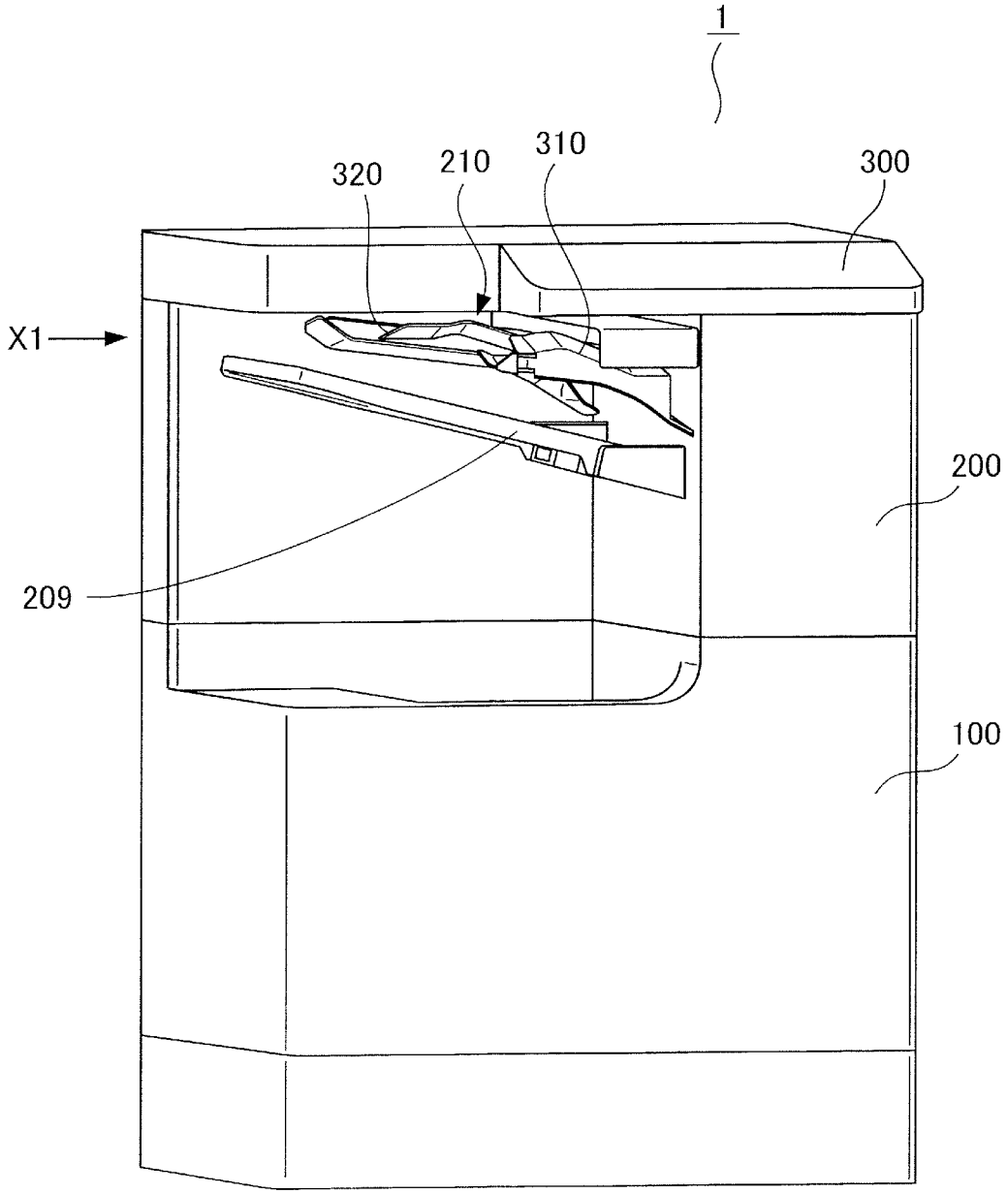
FIG. 24 is a perspective view of an image forming apparatus according to the fifth embodiment.
Figure 25:
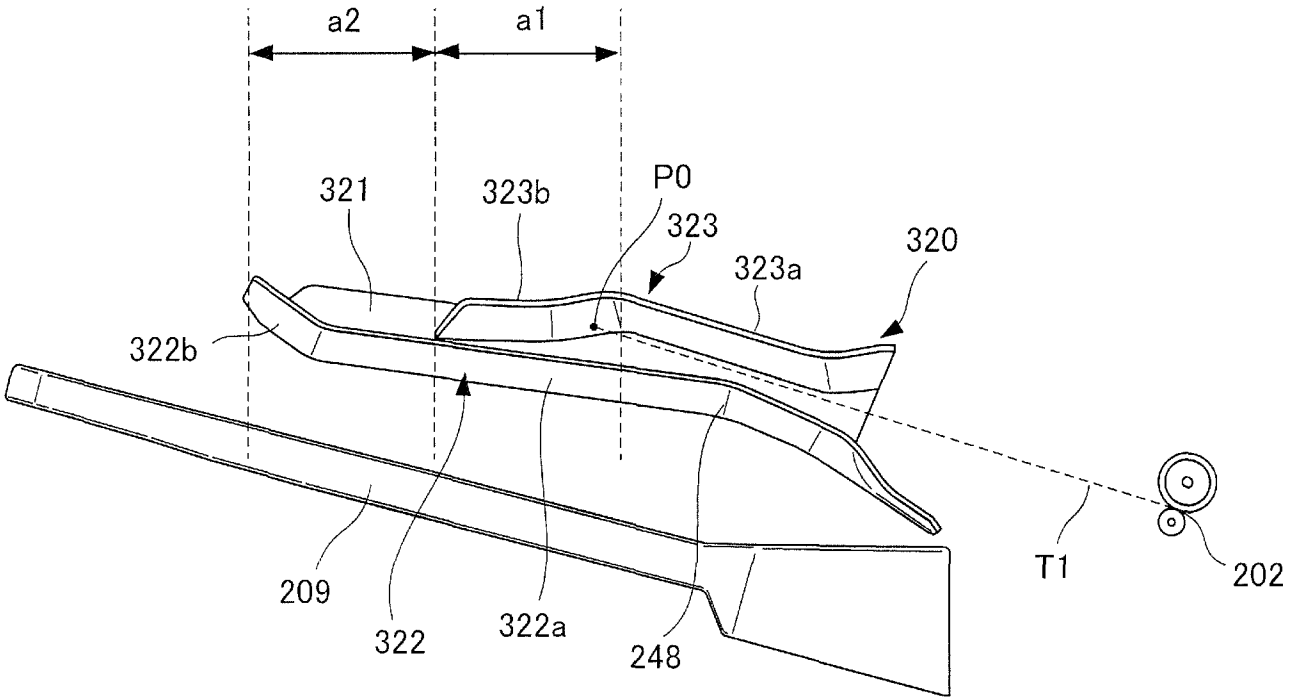
FIG. 25 is a side view illustrating a second alignment member viewed from the width direction according to the fifth embodiment.
Figure 26:
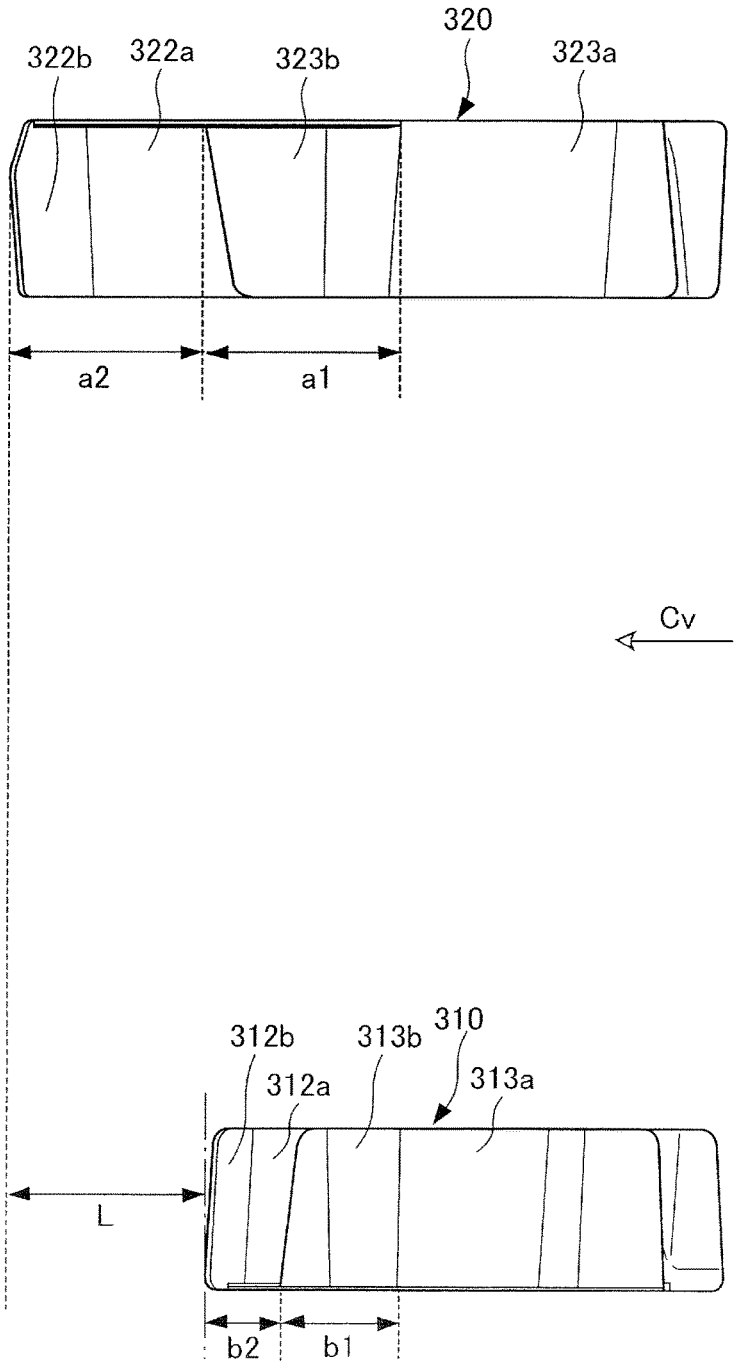
FIG. 26 is an upper view of the widthwise alignment member according to the fifth embodiment.

As illustrated in FIGS. 24 through 26, the second alignment member 320 is extended further downstream than the downstream end of the first alignment member 310 in the conveyance direction (Cv) of the sheet, and the first alignment member 310 positioned at the front side of the image forming apparatus 1 is configured shorter by a length L. Thereby, similar to the first embodiment, access performance from the front side of the apparatus to the sheet discharge tray 209 is ensured.

As illustrated in FIG. 25, the second alignment member 320 includes a first area a1 in which the distance between the lower support surface 322 and the upper support surface 323 reduces toward the downstream side in the conveyance direction of the sheet. At least a portion of the first area a1 in the conveyance direction is disposed closer to the downstream end than the upstream end of the second alignment member 320. The upper support surface 323 in the first area a1, that is, a second upper surface portion 323*b*, intersects with a virtual line which passes through the nip of the conveyance roller pair 202 and along which the sheet S discharged from the second the conveyance roller pair 202 illustrated by dashed line T1. Therefore, the sheet S being conveyed by the second the conveyance roller pair 202 contacts the upper support surface 323 at position of point P0, and the sheet is conveyed with the leading edge of the sheet bent downward in the gravity direction.

Thereafter, in a state where the sheet S is moved to the alignment position by the conveyance of the second the conveyance roller pair 202, the sheet is positioned such that the upper side in the gravity direction viewed from the width direction of the sheet is curved in a convex by the first alignment member 310 and the second alignment member 320. Therefore, the stiffness of the sheet in the width direction during alignment of the sheet is increased, and the sheet can be moved reliably to the alignment position by the first alignment member 310 and the second alignment member 320.

Further, as illustrated in FIG. 25, the second alignment member 320 has a second area a2 in which the lower support surface 322 is disposed downstream in the conveyance direction of the sheet than the first area a1 and where the upper support surface 323 is not provided. This configuration enables to avoid such situations that if the second area where the distance between the lower support surface 322 and the upper support surface 323 reduces toward the conveyance direction of the sheet is extended to the most downstream end, not enough space can be ensured for processing the number of sheets S that can be subjected to the binding process.

Further, as illustrated in FIG. 26, a side wall 321 serving as an alignment surface is configured to extend upward in the gravity direction than the upper support surface 322 in the second area. The first alignment member 310 includes a first area b1 and a second area b2, similar to the second alignment member 320. Further, the lower support surface 322 of the second alignment member 320 includes the second lower surface portion 322*b* serving as an inclined portion for lifting the sheet S upward in the gravity direction at the most downstream edge in the conveyance direction of the sheet. Similarly, the lower support surface 312 of the first alignment member 310 includes the second lower surface portion 312*b* serving as an inclined portion at the most downstream side in the conveyance direction. The plurality of sheets S having been aligned is subjected to binding process by the stapler 208, and thereafter, the leading edge side of the sheet S is lifted up in the upper direction by the second lower surface portions 312*b* and 322*b* which are inclined so as to be further upward than the direction in which the planar first lower surface portions 312*a* and 322*a* (refer to FIGS. 19 and 20) extend, such that the sheets S can be discharged without pushing the sheet S supported on the sheet discharge tray 209. As a result, the aligning performance of the sheet bundle supported on the sheet discharge tray 209 can be improved.

Sixth Embodiment

Figure 27:
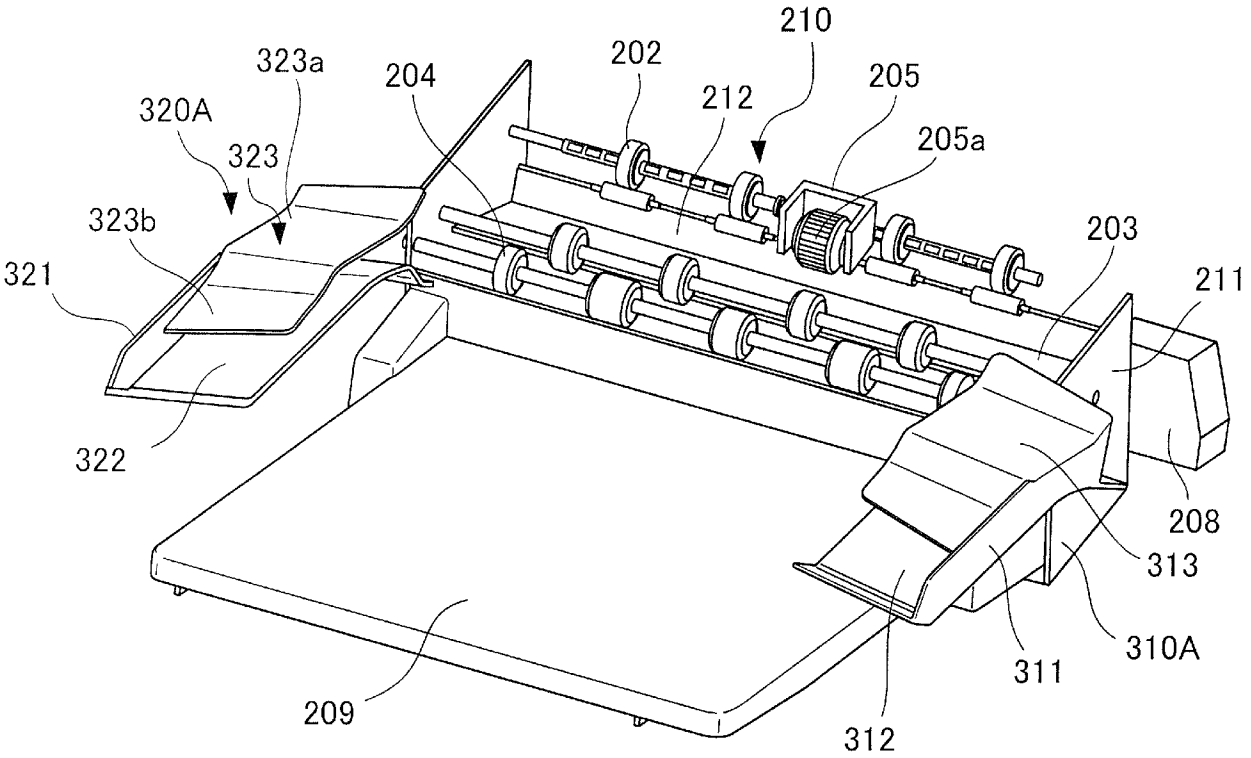
FIG. 27 is a perspective view of a sheet processing apparatus according to a sixth embodiment.

A sixth embodiment will be described with reference to FIGS. 27 and 28. In the following description of the sixth embodiment, the configurations and operations common with the fifth embodiment are denoted with the same reference numbers, and the explanations thereof are omitted. FIG. 27 is a perspective view illustrating the sheet processing apparatus from a sheet discharge port direction. FIG. 29 is a view illustrating a first alignment member 310A and a second alignment member 320A from a top surface of the apparatus.

Figure 28:
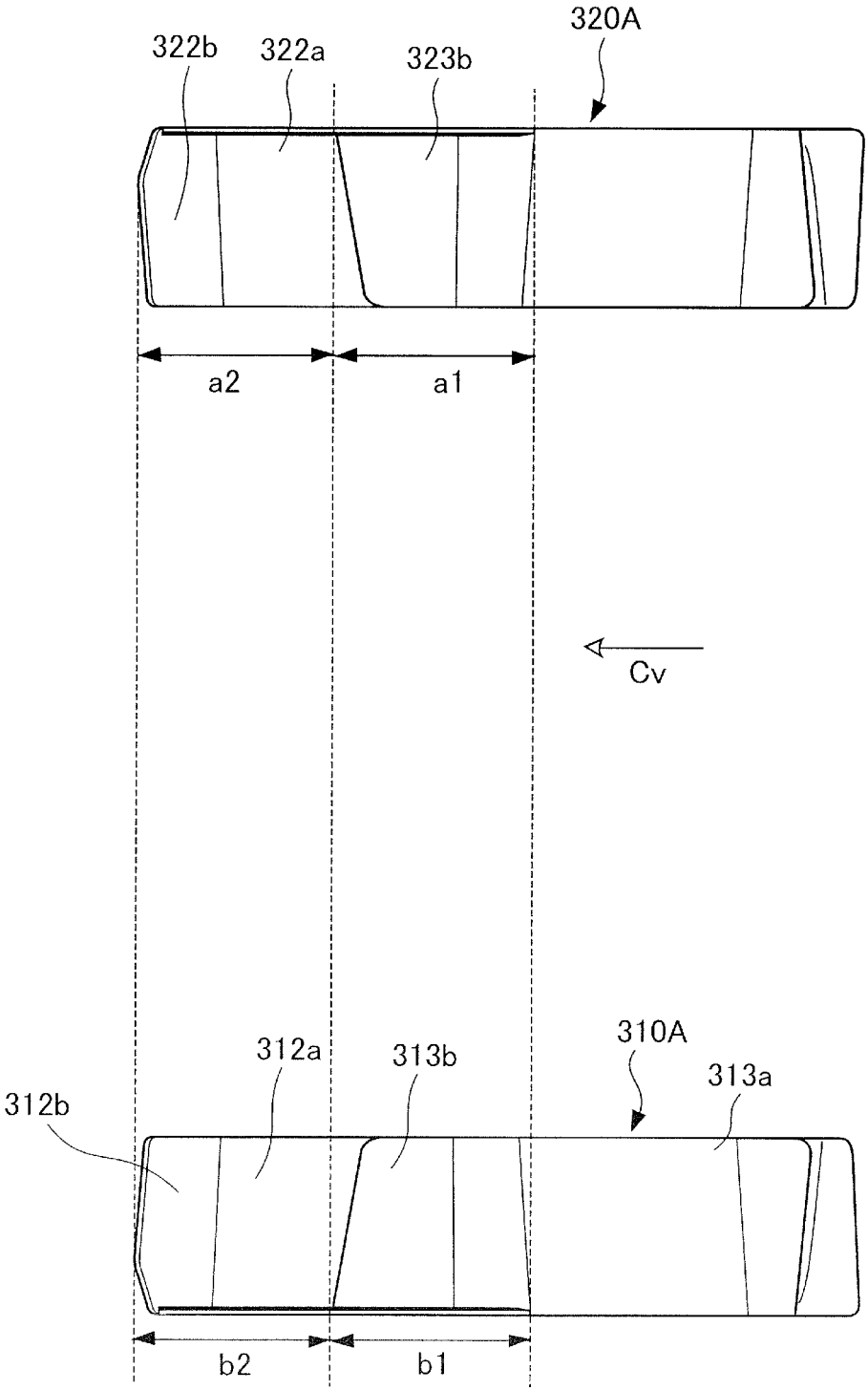
FIG. 28 is a side view of a second alignment member of a sixth embodiment viewed from a width direction.
Figure 29:
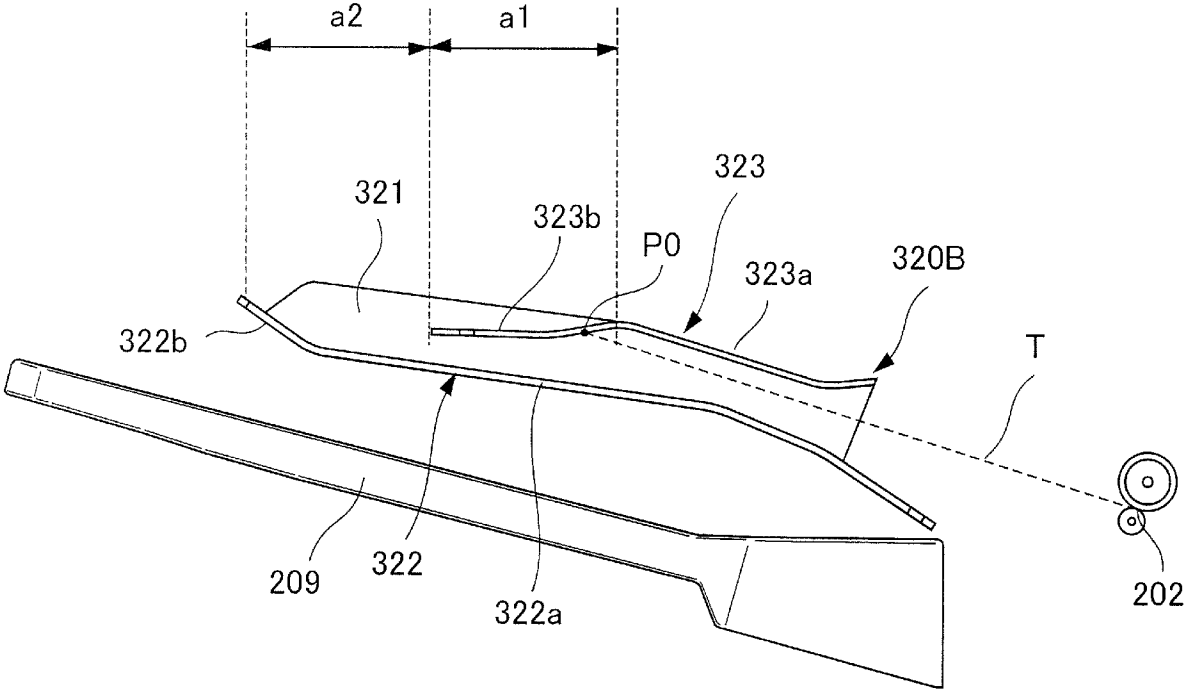
FIG. 29 is a front view of a second alignment member according to a seventh embodiment.

As illustrated in FIGS. 27 and 28, the lengths of the first alignment member 310A and the second alignment member 320A in the conveyance direction are the same. The length of the alignment members in the conveyance direction is set to a minimum necessary length for aligning a long sheet and stacking the sheets to the sheet discharge tray 209 with high accuracy. By setting the length of the first alignment member 310A to be the same length as the second alignment member 320A as according to the present embodiment, a gap in the gravity direction between the alignment member in the width direction and the sheet discharge tray can be narrowed, and the height of the apparatus body can be reduced. Each of the first and second alignment members 310A and 320A include first areas a1 and b1 and second areas a2 and b2, and include second lower surface portions 312*b* and 322*b* as inclined portions, similar to the fifth embodiment.

The present embodiment adopts a configuration in which a post-processing apparatus is mounted on top of the image forming apparatus body, without an image reading apparatus attached thereon, and the direction in which the sheet is discharged is set as the front side of the product. Since the user accesses the sheets S supported on the sheet discharge tray 209 from the sheet discharge direction, a configuration is preferable in which the first alignment member 310A and the second alignment member 320A do not have much influence on the accessibility of the sheets S, and therefore, a configuration where the lengths of the members are aligned in the sheet discharge direction is preferable.

Seventh Embodiment

Figure 30:
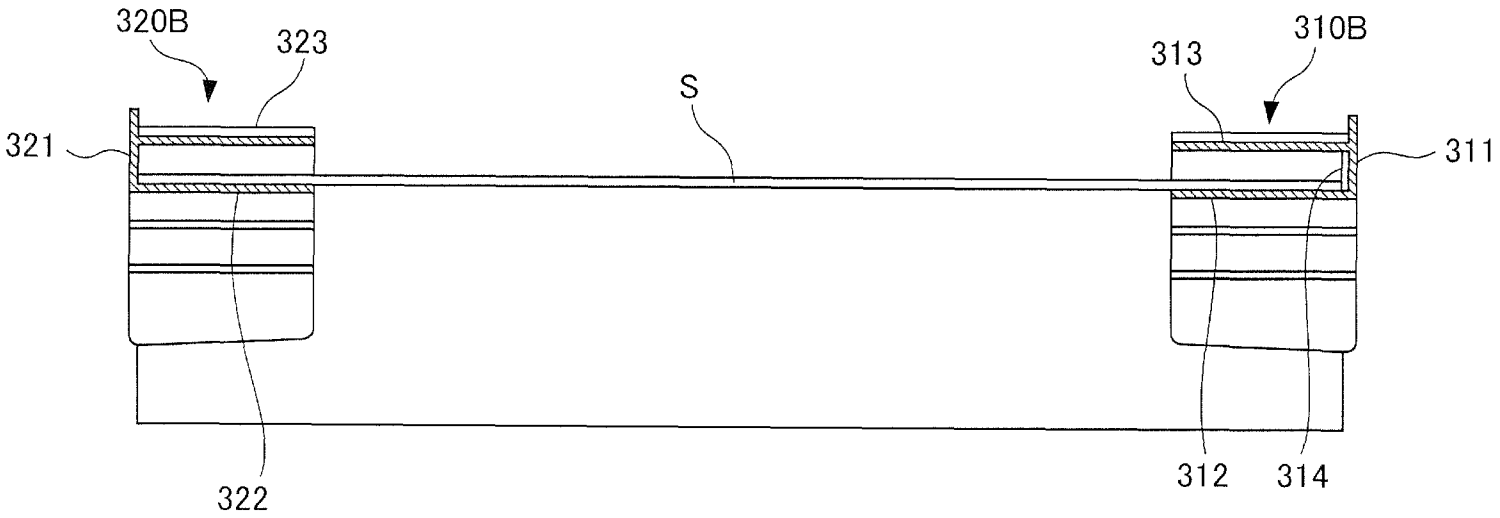
FIG. 30 is a cross-sectional view of a widthwise alignment member during alignment of a first sheet according to the seventh embodiment viewed from a downstream side in the sheet conveyance direction.

A seventh embodiment will be described with reference to FIGS. 29 and 30. In the following description of the seventh embodiment, the configurations and operations common to the fifth embodiment will be assigned with the same reference numbers as the fifth embodiment, and the descriptions thereof are omitted. FIG. 29 is a front view of a second alignment member 320B, and the dotted line illustrates a course of the sheet discharged from the second the conveyance roller pair 202. FIG. 30 illustrates a cross-sectional view taken from a sheet discharge direction in a state where a first sheet being conveyed by the second the conveyance roller pair 202 is aligned by the first alignment member 310B and the second alignment member 320B.

As illustrated in FIG. 29, a most downstream side of the upper support surfaces 313 and 323 is arranged at an angle in which the sheet S is bent toward the lower side with respect to a nip line T of the sheet S being discharged from the second conveyance roller pair 202 illustrated by the dotted line, similar to the fifth embodiment. As a result, the leading edge of the sheet S is bent downward, and the stiffness of the sheet S in the width direction is increased, according to which the sheet S can be moved reliably to the alignment position.

Meanwhile, as illustrated in FIG. 30, if the widthwise alignment members 310B and 320B are viewed from the discharge direction of the sheet S, all of the upper support surfaces 313 and 323 and the lower support surfaces 312 and 322 are arranged in parallel with the conveyance direction and the width direction of the sheet S. As a result, the number of sheets capable of being arranged in the alignment member can be increased with respect to the sheet, and the number of sheets that can be subjected to aligning process at the same time can be increased.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2016-206928, filed on Oct. 21, 2016, 2016-208156, filed on Oct. 24, 2016, and 2017-004597, filed on Jan. 13, 2017, which are hereby incorporated by reference wherein in their entirety.

What is claimed is:

1. A sheet processing apparatus, comprising:

a conveyance member configured to convey a sheet; and an alignment portion comprising a first alignment member and a second alignment member and configured to move relative positions of the first and second alignment members in a width direction orthogonal to a conveyance direction of the sheet by the conveyance member, so as to align a position of the sheet in the width direction, the first alignment member comprising:

a first contact surface configured to come in contact with one end of the sheet in the width direction;

a first lower surface configured to face a lower surface of the sheet that is in contact with the first contact surface;

a first lower portion configured to support the lower surface of the sheet that is in contact with the first contact surface; and a first upper portion facing an upper surface of the sheet that is in contact with the first contact surface, wherein in a plane vertical to the conveyance direction, the first lower surface extends from a lower end of the first contact surface toward the second alignment member in the width direction, the first lower surface is inclined so as to be further upward as the first lower surface extends toward the second alignment member in the width direction, and the first lower portion is arranged at an end portion of the first lower surface on a far side from the first contact surface in the width direction, wherein in the plane vertical to the conveyance direction, the first lower portion is more distant from the first contact surface than the first upper portion in the width direction, the first lower portion is positioned above the lower end of the first contact surface in a gravity direction, and a distance between the first upper portion and the first lower portion in the gravity direction is smaller than a length of the first contact surface in the gravity direction, the second alignment member comprising:

a second contact surface configured to come in contact with the other end of the sheet in the width direction;

a second lower surface configured to face a lower surface of the sheet that is in contact with the second contact surface;

a second lower portion configured to support the lower surface of the sheet that is in contact with the second contact surface; and a second upper portion facing an upper surface of the sheet that is in contact with the second contact surface, wherein in the plane vertical to the conveyance direction, the second lower surface extends from a lower end of the second contact surface toward the first alignment member in the width direction, the second lower surface is inclined so as to be further upward as the second lower surface extends toward the first alignment member in the width direction, and the second lower portion is arranged at an end portion of the second lower surface on a far side from the second contact surface in the width direction, wherein in the plane vertical to the conveyance direction, the second lower portion is more distant from the second contact surface than the second upper portion in the width direction, the second lower portion is positioned above the lower end of the second contact surface in the gravity direction, and a distance between the second upper portion and the second lower portion in the gravity direction is smaller than a length of the second contact surface in the gravity direction.

2. The sheet processing apparatus according to claim 1, wherein the first alignment member further comprises a first upper surface extending from an upper end of the first contact surface toward the second alignment member in the width direction and configured to face the upper surface of the sheet that is in contact with the first contact surface, wherein the second alignment member further comprises a second upper surface extending from an upper end of the second contact surface toward the first alignment member in the width direction and configured to face the upper surface of the sheet that is in contact with the second contact surface, and wherein the first and second upper portions are respectively arranged on the first and second upper surfaces.

3. The sheet processing apparatus according to claim 2, wherein the first upper surface is inclined so as to be further upward as the first upper surface extends toward the second alignment member in the width direction, and the second upper surface is inclined so as to be further upward as the second upper surface extends toward the first alignment member in the width direction, and wherein the first upper portion is an end portion of the first upper surface adjacent to the upper end of the first contact surface, and the second upper portion is an end portion of the second upper surface adjacent to the upper end of the second contact surface.

4. The sheet processing apparatus according to claim 2, wherein the conveyance member is a conveyance roller pair, and each of the first and second upper surfaces comprises a portion that intersects with a tangent line of the conveyance roller pair at a nip portion of the conveyance roller pair when viewed in the width direction.

5. The sheet processing apparatus according to claim 2, wherein the second alignment member further extends downstream in the conveyance direction than a downstream end of the first alignment member in the conveyance direction, and wherein the second lower surface of the second alignment member comprises a first portion facing the second upper surface and a second portion arranged downstream of the second upper surface in the conveyance direction of the second alignment member so that the second portion is not covered by the second upper surface, the second portion being further upward as the second portion extends downstream in the conveyance direction with respect to a direction in which the first portion extends when viewed in the width direction.

6. The sheet processing apparatus according to claim 5, further comprising a conveyance direction alignment portion configured to align a position in the conveyance direction of the sheet aligned by the alignment portion, wherein the alignment portion is capable of aligning both a sheet having a first size and a sheet having a second size that has a length in the conveyance direction greater than the first size, and the second portion of the second lower surface is positioned in the conveyance direction between a downstream end of the sheet having the first size aligned by the conveyance direction alignment portion and a downstream end of the sheet having the second size aligned by the conveyance direction alignment portion.

7. The sheet processing apparatus according to claim 2, wherein the second lower surface of the second alignment member extends further downstream than a downstream end of the first alignment member in the conveyance direction, and the second lower surface comprises a first area facing the second upper surface and a second area arranged downstream of the second upper surface in the conveyance direction so that the second area is not covered by the second upper surface.

8. The sheet processing apparatus according to claim 7, wherein the conveyance member is a conveyance roller pair, wherein the second alignment member is configured such that a distance between the first area of the second lower surface and the second upper surface in the gravity direction decreases as the first area extends downstream in the conveyance direction, and wherein the second upper surface comprises a portion that intersects with a tangent line of the conveyance roller pair at a nip portion of the conveyance roller pair when viewed in the width direction.

9. The sheet processing apparatus according to claim 7, wherein the alignment portion is configured to align the sheet by moving the second alignment member to approach the first alignment member in the width direction in a state where a position of the first alignment member in the width direction is fixed.

10. The sheet processing apparatus according to claim 7, wherein the second lower surface comprises a third area positioned downstream of the second area in the conveyance direction, and the third area is further upward as the third area extends downstream in the conveyance direction with respect to a direction in which the second area extends.

11. The sheet processing apparatus according to claim 1, wherein the first alignment member further comprises a first upper surface extending from an upper end of the first contact surface, inclined so as to be further upward as the first upper surface extends toward the second alignment member in the width direction, and configured to face the upper surface of the sheet that is in contact with the first contact surface, wherein the second alignment member further comprises a second upper surface extending from an upper end of the second contact surface, inclined so as to be further upward as the second upper surface extends toward the first alignment member in the width direction, and configured to face the upper surface of the sheet that is in contact with the second contact surface, and wherein the first upper portion is an end portion of the first upper surface adjacent to the upper end of the first contact surface, and the second upper portion is an end portion of the second upper surface adjacent to the upper end of the second contact surface.

12. The sheet processing apparatus according to claim 1, wherein each of the first and second lower surfaces comprises a curved portion curved such that a direction in which the curved portion extends turns from upward toward downward as the curved portion extends downstream in the conveyance direction, so that the first and second lower surfaces can support the sheet in a curved state when viewed in the width direction.

13. The sheet processing apparatus according to claim 1, further comprising:

a supporting portion arranged upstream of the first and second alignment members in the conveyance direction and configured to support an upstream portion in the conveyance direction of the sheet to be aligned by the alignment portion;

a sheet discharge member arranged between the supporting portion and the first and second alignment members in the conveyance direction and configured to discharge the sheet aligned by the alignment portion; and a sheet discharge portion arranged below the first and second alignment members and configured such that the sheet discharged by the sheet discharge member is stacked on the sheet discharge portion, wherein the sheet discharge member discharges the sheet to the sheet discharge portion by conveying the sheet aligned by the alignment portion in the conveyance direction.

14. An image forming apparatus comprising:

an image forming portion configured to form an image on a sheet; and the sheet processing apparatus according to claim 1, the sheet processing apparatus being configured to process the sheet on which an image has been formed by the image forming portion.

15. A sheet processing apparatus comprising:

a conveyance member configured to convey a sheet; and an alignment portion comprising a first alignment member and a second alignment member and configured to move relative positions of the first and second alignment members in a width direction orthogonal to a conveyance direction of the sheet by the conveyance member, so as to align a position of the sheet in the width direction, the first alignment member comprising:

a first contact surface configured to come in contact with one end of the sheet in the width direction;

a first lower surface configured to face a lower surface of the sheet that is in contact with the first contact surface;

a first lower portion configured to support the lower surface of the sheet that is in contact with the first contact surface; and a first upper portion facing an upper surface of the sheet that is in contact with the first contact surface, wherein in a plane vertical to the conveyance direction, the first lower portion is more distant from the first contact surface than the first upper portion in the width direction, the first lower portion is positioned above a lower end of the first contact surface in a gravity direction, and a distance between the first upper portion and the first lower portion in the gravity direction is smaller than a length of the first contact surface in the gravity direction, the second alignment member comprising:

a second contact surface configured to come in contact with the other end of the sheet in the width direction;

a second lower surface configured to face a lower surface of the sheet that is in contact with the second contact surface;

a second lower portion configured to support the lower surface of the sheet that is in contact with the second contact surface; and a second upper portion facing an upper surface of the sheet that is in contact with the second contact surface, wherein in the plane vertical to the conveyance direction, the second lower portion is more distant from the second contact surface than the second upper portion in the width direction, the second lower portion is positioned above a lower end of the second contact surface in the gravity direction, and a distance between the second upper portion and the second lower portion in the gravity direction is smaller than a length of the second contact surface in the gravity direction, and wherein in the plane vertical to the conveyance direction, the first and second lower portions are respectively projecting portions projecting upward from the first and second lower surfaces.

16. A sheet processing apparatus comprising:

a conveyance member configured to convey a sheet; and an alignment portion comprising a first alignment member and a second alignment member and configured to move relative positions of the first and second alignment members in a width direction orthogonal to a conveyance direction of the sheet by the conveyance member, so as to align a position of the sheet in the width direction, the first alignment member comprising:

a first contact surface configured to come in contact with one end of the sheet in the width direction;

a first lower surface configured to face a lower surface of the sheet that is in contact with the first contact surface;

a first lower portion configured to support the lower surface of the sheet that is in contact with the first contact surface; and a first upper portion facing an upper surface of the sheet that is in contact with the first contact surface, wherein in the plane vertical to the conveyance direction, the first lower portion is more distant from the first contact surface than the first upper portion in the width direction, the first lower portion is positioned above a lower end of the first contact surface in a gravity direction, and a distance between the first upper portion and the first lower portion in the gravity direction is smaller than a length of the first contact surface in the gravity direction, the second alignment member comprising:

a second contact surface configured to come in contact with the other end of the sheet in the width direction;

a second lower surface configured to face a lower surface of the sheet that is in contact with the second contact surface;

a second lower portion configured to support the lower surface of the sheet that is in contact with the second contact surface; and a second upper portion facing an upper surface of the sheet that is in contact with the second contact surface, wherein in the plane vertical to the conveyance direction, the second lower portion is more distant from the second contact surface than the second upper portion in the width direction, the second lower portion is positioned above a lower end of the second contact surface in the gravity direction, and a distance between the second upper portion and the second lower portion in the gravity direction is smaller than a length of the second contact surface in the gravity direction, and wherein in the plane vertical to the conveyance direction, the first and second lower portions are respectively movable members movable in the gravity direction with respect to the first and second lower surfaces and configured to be urged upward.

* * * * *